US010612233B1

(12) United States Patent
Yu et al.

(10) Patent No.: US 10,612,233 B1
(45) Date of Patent: Apr. 7, 2020

(54) MODULAR ASSEMBLY SHELTER KITS AND METHODS

(71) Applicant: United States of America as Represented by The Secretary of The Army, Alexandria, VA (US)

(72) Inventors: Justine A Yu, Wilmington, IL (US); Tanner J Wood, Champaign, IL (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 16/239,483

(22) Filed: Jan. 3, 2019

(51) Int. Cl.

| | |
|---|---|
| ***E04B 1/343*** | (2006.01) |
| ***E04B 1/41*** | (2006.01) |
| ***E04B 1/58*** | (2006.01) |
| ***E04B 1/61*** | (2006.01) |
| ***E04H 9/14*** | (2006.01) |
| ***E04H 9/16*** | (2006.01) |
| ***E04H 9/10*** | (2006.01) |
| *E04B 1/00* | (2006.01) |

(52) U.S. Cl.
CPC ..... *E04B 1/34384* (2013.01); *E04B 1/34321* (2013.01); *E04B 1/34326* (2013.01); *E04B 1/40* (2013.01); *E04B 1/5812* (2013.01); *E04B 1/6187* (2013.01); *E04H 9/10* (2013.01); *E04H 9/14* (2013.01); *E04H 9/16* (2013.01); *E04B 2001/0076* (2013.01); *E04B 2001/34389* (2013.01); *E04B 2001/5887* (2013.01); *E04B 2001/6195* (2013.01)

(58) Field of Classification Search
CPC ..... E04B 1/34321; E04B 1/34326; E04B 2001/5887; E04B 2001/34389; E04B 2001/0076; E04B 1/5812; E04B 1/6187; E04B 1/34384; E04H 9/10; E04H 1/1205; E04H 9/14; E04H 9/16
See application file for complete search history.

(56) References Cited

U.S. PATENT DOCUMENTS

| | | | | |
|---|---|---|---|---|
| 10,480,176 | B2 * | 11/2019 | Unger | E04B 2/58 |
| 2008/0110484 | A1 * | 5/2008 | Doran | E04B 1/34315 135/121 |
| 2010/0018131 | A1 * | 1/2010 | Green | E04B 1/24 52/79.5 |

(Continued)

*Primary Examiner* — Beth A Stephan
(74) *Attorney, Agent, or Firm* — Brian C. Jones

(57) ABSTRACT

In one embodiment, a modular assembly shelter kit is provided for rapid deployment in a remote location. The shelter kit includes headers, footers, upper horizontal beams, lower horizontal beams, roof, floor, and wall panels, and vertical support columns. The horizontal beams have notched hooks which form cross joints when engaged with notched hooks of adjacent horizontal beams. The cross joints can be placed against the headers or footers, and caged into position by prongs of the vertical support columns. The horizontal beams can also include grooves for holding interior and exterior wall panels, and interior ledges for holding roof and floor panels. Unique geometrically designed components deployed military or humanitarian responders with the ability to quickly manufacture and install such shelters in a wide variety of environments.

20 Claims, 14 Drawing Sheets

(56) References Cited

U.S. PATENT DOCUMENTS

| | | | | |
|---|---|---|---|---|
| 2010/0043309 | A1* | 2/2010 | Martin | E03C 1/01 52/79.5 |
| 2016/0222643 | A1* | 8/2016 | Castelli | A63H 33/105 |
| 2017/0218617 | A1* | 8/2017 | Banal | E04B 1/34321 |
| 2018/0340326 | A1* | 11/2018 | Pirrung | E04B 1/34315 |

* cited by examiner

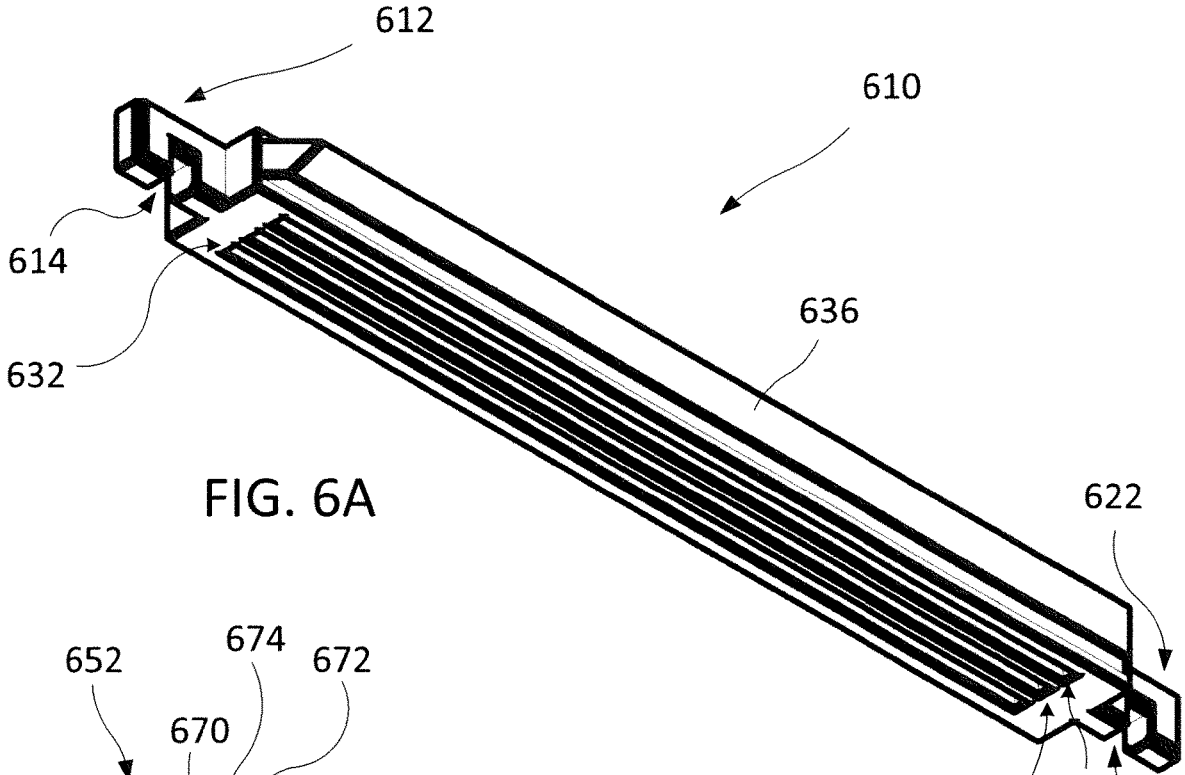
FIG. 6A
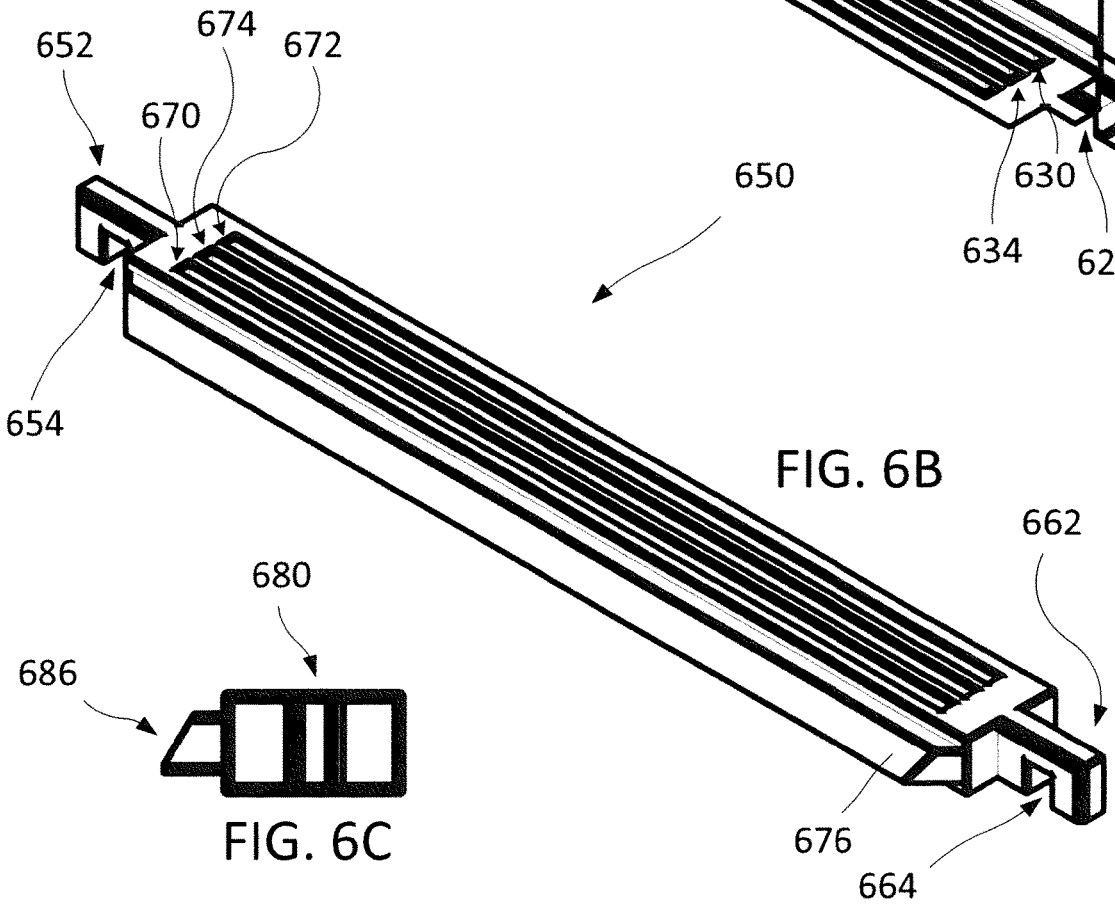
FIG. 6B
FIG. 6C

MODULAR ASSEMBLY SHELTER KITS AND METHODS

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to shelter structures, and, particularly but not exclusively, to rapid assembly shelter kits having a modular design.

Description of the Related Art

This section introduces aspects that may help facilitate a better understanding of the invention. Accordingly, the statements of this section are to be read in this light and are not to be understood as admissions about what is prior art or what is not prior art.

The U.S. military and humanitarian organizations are tasked to provide rapid response capability across various austere locations, with time of duration ranging from months to years. The infrastructure utilized for these operations is typically multi-modal, ranging from camp systems (tent camps) to full stick-built type construction. Existing designs may, however, involve complex logistics, design, and contracting time requirements, resulting in increased efficiencies for military and disaster relief operations. Relatedly, such existing designs may not provide deployed military or humanitarian responders with the ability to quickly adapt to a wide variety of possible shelter requirements and environments. For example, traditional construction methods such as timber frame and masonry can require skilled laborers or lengthy construction times.

Moreover, conventional hardened structures often require the availability and use of power tools or heavy equipment for purposes of assembly. The kit embodiments disclosed herein are quickly deployable, and can provide hardened structures, thus providing the advantages of quick deployment such as tents, while also providing the advantages of rigidity and strength comparable to a conventional stick built structure. Hence, although many traditional and conventional approaches can effectively meet many critical infrastructure requirements, still further improvements in shelter structure designs are desirable. Embodiments of the present invention provide solutions for at least some of these outstanding needs.

SUMMARY

The present invention was developed to address the challenges associated with existing shelter systems and methods, for example as described in the above Background section of this application. Research and development has led to a novel approach for providing shelter systems in austere locations.

The present invention advances the technology of rapid assembly shelter kits. This disclosure describes a new modular assembly shelter kit intended to replace currently known shelter systems. Particular focus will be placed on the modular nature of the shelter kit and the use of shelter kit construction techniques for providing a rapid assembly shelter for use in remote locations. The kits methods presented here are more efficient and effective than prior methodologies.

In contrast to currently available multi-modal infrastructure solutions, embodiments of the present invention encompass unique unimodal components that can be effectively utilized across the mission functions with various space requirements, with adaptations and reconfigurations amenable for changes in mission, manpower, and duration.

The on-site manufacture of standardized and modular construction components as disclosed herein can greatly decrease logistics, design and contracting time, resulting in increased efficiencies for military and disaster relief operations. These technologies, techniques, and processes enable highly mobile deployed military or humanitarian responders to have the ability to quickly adapt to all possible shelter requirements and environments. The kit embodiments disclosed herein are quickly deployable, and can provide hardened structures, thus providing the advantages of quick deployment such as tents, while also providing the advantages of rigidity and strength comparable to a conventional stick built structure.

Compared to traditional construction methods, like timber frame and masonry, kit embodiments disclosed herein do not require skilled laborers or lengthy construction times. Unlike conventional hardened structures, there is no need for power tools or heavy equipment to assemble or erect these kit structures.

A novel shelter kit can be additively manufactured and utilizes innovative geometry to minimize support material and reduce post processing. The additive manufacturing process can be performed on-site close to point of need or off-site location. After printing, the system is ready to be assembled and does not need cure time for full structural strength.

BRIEF DESCRIPTION OF THE DRAWINGS

Embodiments of the invention will become more fully apparent from the following detailed description, the appended claims, and the accompanying drawings in which like reference numerals identify similar or identical elements.

FIG. 6A depicts aspects of a horizontal beam according to certain embodiments of the invention:

FIG. 6B depicts aspects of a horizontal beam according to certain embodiments of the invention;

FIG. 8C depicts aspects of a horizontal beam according to certain embodiments of the invention;

DETAILED DESCRIPTION

Figure 1:
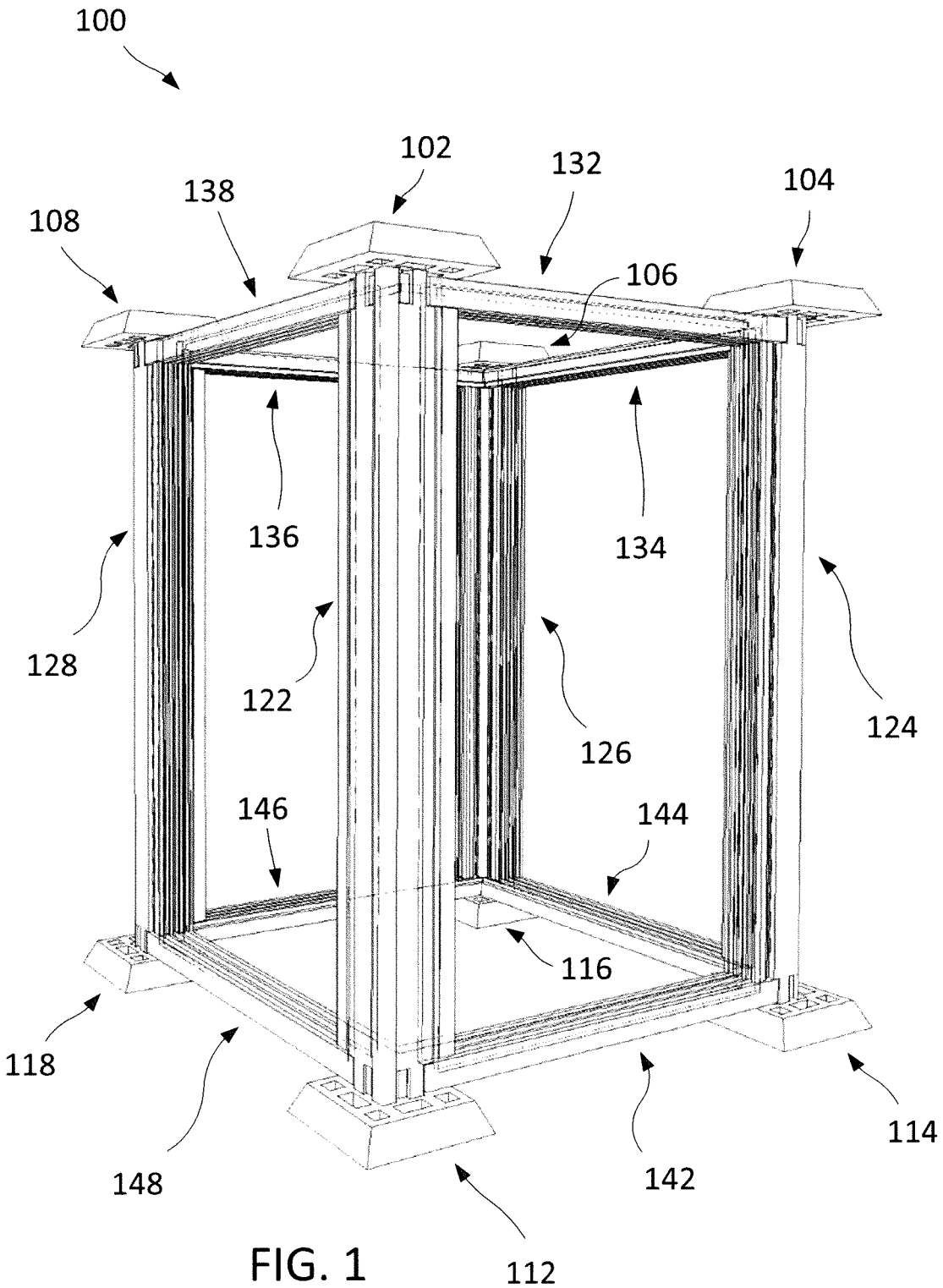
FIG. 1 depicts an exemplary modular assembly shelter kit according to certain embodiments of the invention.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In at least one embodiment, the present invention aims to address the shortcomings of existing shelter systems by providing an innovative modular assembly shelter kit that can be easily manufactured, used, and reused over multiple use cycles, and that can be repaired with easily replaceable components parts.

The Modular Assembly Shelter Kit (MASh Kit) is an additively manufactured, portable, lightweight, flexible system for rapid construction of shelters. It is a kit-of-parts solution that uses pre-engineered construction techniques and materiel to make up prefabricated assemblies of discrete standardized building components. A basic kit can provide a sized (6'×6') shelter which can be joined together in various ways allowing the functionality, footprint, and environmental constraints to meet the user need for quick shelter in an austere location. The double layer of paneling allows for added flexibility for variety of infills depending on user needs (i.e. filled with earth to increase ballistic protection and reduce thermal conductivity). The modular nature allows for damaged parts to be replaced easily without manufacturing a whole new kit. No bolts or fasteners are required for ease of assembly and disassembly.

The kit can be additively manufactured and utilizes innovative geometry to minimize support material and reduce post processing. The additive manufacturing process can be performed on-site close to point of need or off-site. After printing, the system is ready to be assembled and does not need cure time for full structural strength.

According to some embodiments, the kit system is portable and lightweight, and is easy to transport. Advantageously, components of the kit could make up the shipping package. The shelter is compact in transport with a small shipping to deployed footprint ratio, on the order of 1 to 4. The components are lightweight and could be handled by one individual and assembled by two. Additional materials can be added in between the double layer of paneling to increase structural integrity of the system.

Due to the modular nature of the design, the function is flexible to meet varying requirements. A single kit can be used for an individual shelter or multiple kits can be joined together to expand the footprint and accommodate more people. Functional furniture (desk/bunk bed) can be clipped into vertical members. Due to the lack of bolts and fasteners, if a user needs to change the layout, the system can easily accommodate reconfiguration. When the shelter is no longer needed, it can be repacked, relocated, and reused.

Kit embodiments disclosed herein are designed for additive manufacturing, rapid assembly, easy process in deployment, and require less manpower and transportation logistics than conventional practices of constructing structures in austere locations. Kit embodiments can be universal in function to expand (incorporating multiple kits) based the need of shelter footprint. Other previously known shelters require bolts and fasteners, whereas kit embodiments disclosed herein rely on gravity loaded joinery techniques. The connection techniques disclosed herein are uncomplicated and efficient, and are also robust for ease of erection processes and lends themselves to automated assembly.

Previously known shelters do not meet such criteria, in terms of ease of assembly/disassembly, portability, standardized parts, additively manufactured, or structural integrity. Advantageously, kit embodiments disclosed herein can meet such criteria.

What is more, previously known shelters require more logistics for transporting shelter to the point of need, whereas kit embodiments as disclosed herein can be on-site manufactured. An exemplary kit embodiment will enable deployed military forces with sheltering options during deployed situations. Other uses for kit embodiments include providing durable shelters in humanitarian disaster relief efforts, as well as long term refugee and displaced persons in remote locations. Kit embodiments can be utilized for consumer outdoor storage applications as well.

According to some embodiments, exemplary kits can be constructed using gravity loaded joinery techniques, without requiring bolts or fasteners. Kits provide users with the ability to expand a shelter by adding more kits. According to some embodiments, the components are designed to have the least amount of custom parts. For example, the floor (e.g. horizontal lower) and roof (e.g. horizontal upper) beams can have the same shape or design. Similarly, the footers and headers can have the same shape or design. Individual kit component parts are designed to be easily exchanged when broken or damaged, without requiring replacement of a whole kit. Kit components can be additively manufactured with minimal support material. Kit embodiments that include multiple wall panels with and infill approach allows for customization of the end goal of the shelter (i.e. thermal storage or ballistic protection). In some embodiments, components can be configured into a self-containing shipping package.

Embodiments of the present invention encompass modular assembly shelter kits, and methods for their use and manufacture. Any one or more of the individual components of a modular assembly shelter kit can be fabricated using additive and/or subtractive techniques. In some cases, one or more components can be manufactured on-site at a point of use. Components can be manufactured in remote locations, or can be manufactured and transported to remote locations for subsequent assembly and installation. Vacuum systems can be used to collect unused material for reuse. Exemplary embodiments provide a modular, portable, lightweight, and flexible system, including an assembly of standardized components, that can be quickly assembled to create a structure, and that can also be disassembled quickly. Embodiments of the present invention encompass kits of parts that can be conveniently and efficiently packaged for transport. According to some embodiments, kits are well suited for use with mobile forces and with humanitarian efforts. Contingency bases and emergency response teams can use the kits for rapid shelter.

An exemplary kit provides a 6 foot by 6 foot shelter structure. Multiple kit parts can be joined together in various ways to expand the footprint of a shelter structure, and/or to accommodate more users. According to some embodiments, kit components can be additively constructed with minimal or no post processing. Kits can be assembled to form structures, without requiring the use of bolts or other fasteners. Kit structures can be assembled in a low maintenance manner, using hinge-free connections. Damaged or worn component parts of a kit structure can be replaced individually, without requiring replacement of the entire kit. In some cases, kits contain wall panels that are rectangular in shape, and roof and floor panels that are square in shape. Wall panels and upper (e.g. roof) and lower (e.g. floor) panels can be provided in any desired shape.

Modular Assembly Shelter Kits And Methods

Turning now to the drawings, FIG. 1 depicts aspects of an exemplary modular assembly shelter kit 100, according to embodiments of the present invention. As shown here, modular assembly shelter kit 100 includes a first header 102, a second header 104, and third header 106, a fourth header 108, a first footer 112, a second footer 114, and third footer 116, and a fourth footer 118. Further, modular assembly shelter kit 100 includes a first vertical support mechanism 122, a second vertical support mechanism 124, and third vertical support mechanism 126, and a fourth vertical support mechanism 128. As discussed elsewhere herein, a vertical support mechanism can include a vertical support column and two vertical couplers. Modular assembly shelter kit 100 also includes a first upper horizontal beam 132, a second upper horizontal beam 134, and third upper horizontal beam 136, a fourth upper horizontal beam 138, a first lower horizontal beam 142, a second lower horizontal beam 144, and third lower horizontal beam 146, and a fourth lower horizontal beam 148.

Modular assembly shelter kit 100 can also include one or more panels (not shown) so as to provide a partially or completely enclosed structure. For example, as discussed elsewhere herein, kit 100 can include an upper panel engaged with the upper horizontal beams, a lower panel engaged with the lower horizontal beams, one or more first wall panels engaged with first and second vertical support mechanisms and upper and lower first horizontal beams, one or more second wall panels engaged with second and third vertical support mechanisms and upper and lower second horizontal beams, one or more third wall panels engaged with third and fourth vertical support mechanisms and upper and lower third horizontal beams, and one or more fourth wall panels engaged with fourth and first vertical support mechanisms and upper and lower fourth horizontal beams. In some cases, the one or more wall panels can include an interior wall panel, an exterior wall panel, an intermediate wall panel, or any combination thereof.

Figure 2A:
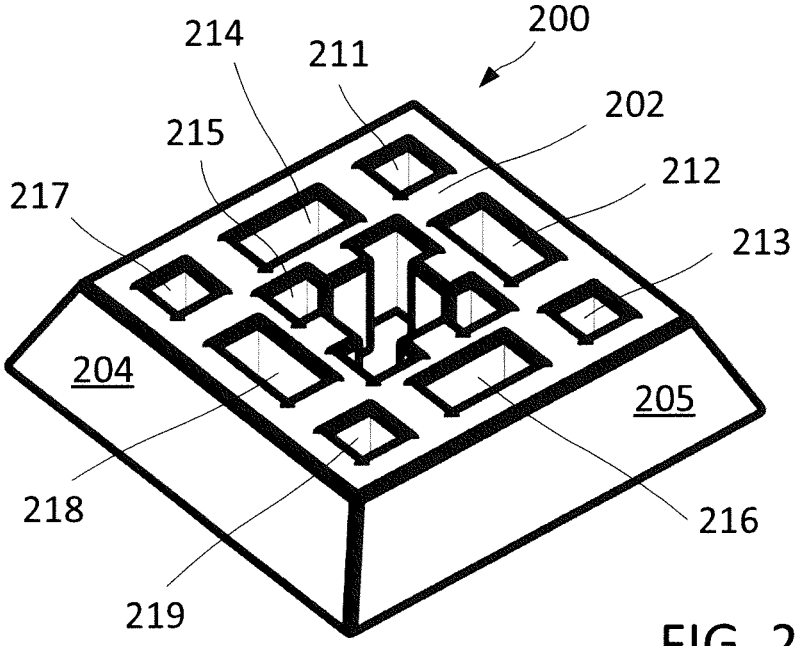
FIG. 2A depicts aspects of header or footer according to certain embodiments of the invention.
Figure 2B:
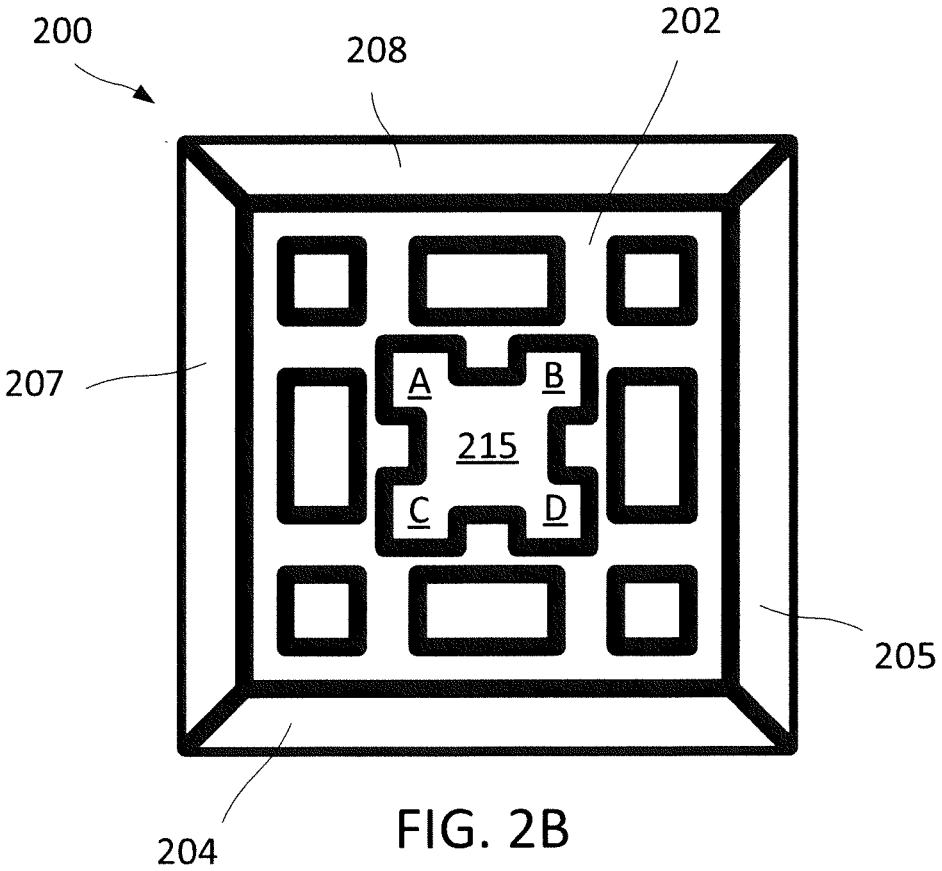
FIG. 2B depicts aspects of header or footer according to certain embodiments of the invention.
Figure 2C:
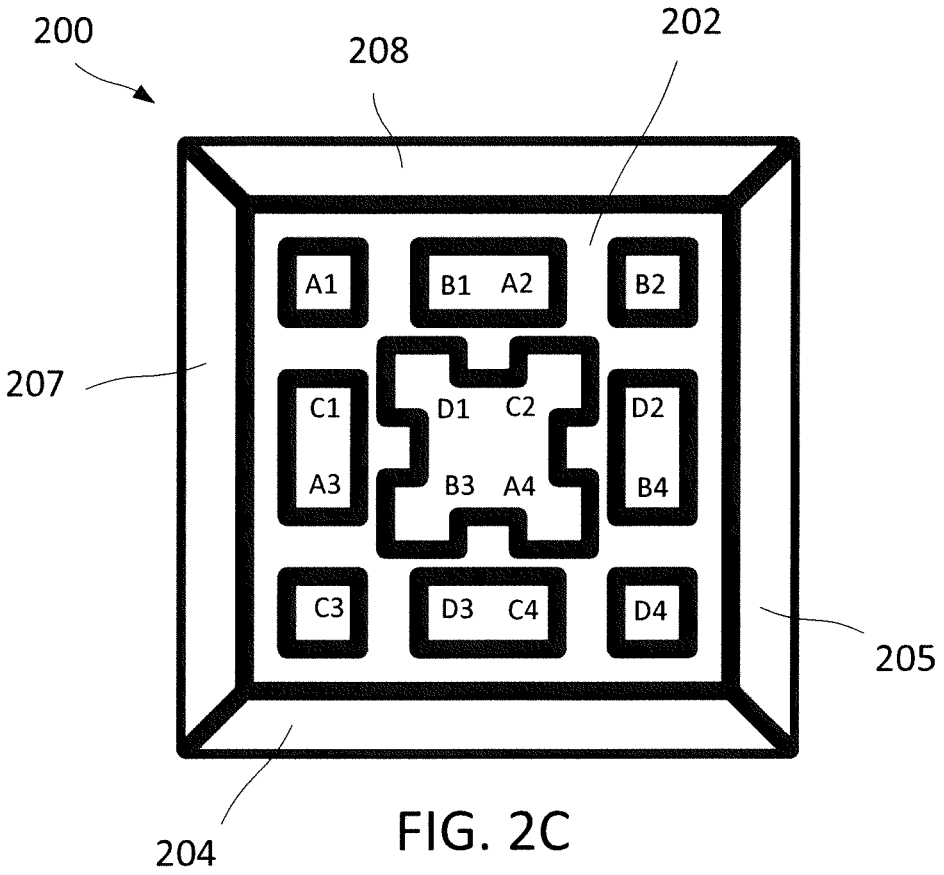
FIG. 2C depicts aspects of header or footer according to certain embodiments of the invention.

FIGS. 2A, 2B, and 2C depict aspects of header (or footer) 200 according to embodiments of the present invention. FIG. 2A provides a perspective view, and FIGS. 2B and 2C provide a top plan views. In some instances, a header and footer may have the same configuration. Header 200 includes an upper surface 202 and a lower surface (not shown). Header 200 may also include one or more beveled sides (e.g. 204, 205, 206, 207) so that the lower surface is larger than the upper surface. Header 200 may include one or more openings configured to receive one or more prongs of one or more vertical support columns. As shown in FIG. 2A, header 200 includes a first opening 211, a second opening 212, a third opening 213, a fourth opening 214, a fifth opening 215, a sixth opening 216, a seventh opening 217, an eighth opening 218, and a ninth opening 219. As shown in FIG. 2B, four prongs of a vertical support column can be received within four respective channels (e.g. a, b, c, d) of fifth opening 215. FIG. 2C depicts an alternate situation, where the header is engaged with multiple vertical support mechanisms. Specifically, the apertures receive four prongs of a first vertical support mechanism (which may include a vertical support column) at locations A1, B1, C1, and D1, four prongs of a second vertical support mechanism at locations A2, B2, C2, and D2, four prongs of a third vertical support mechanism at locations A3, B3. C3, and D3, and four prongs of a fourth vertical support mechanism at locations A4, B4, C4, and D4.

Figure 3:
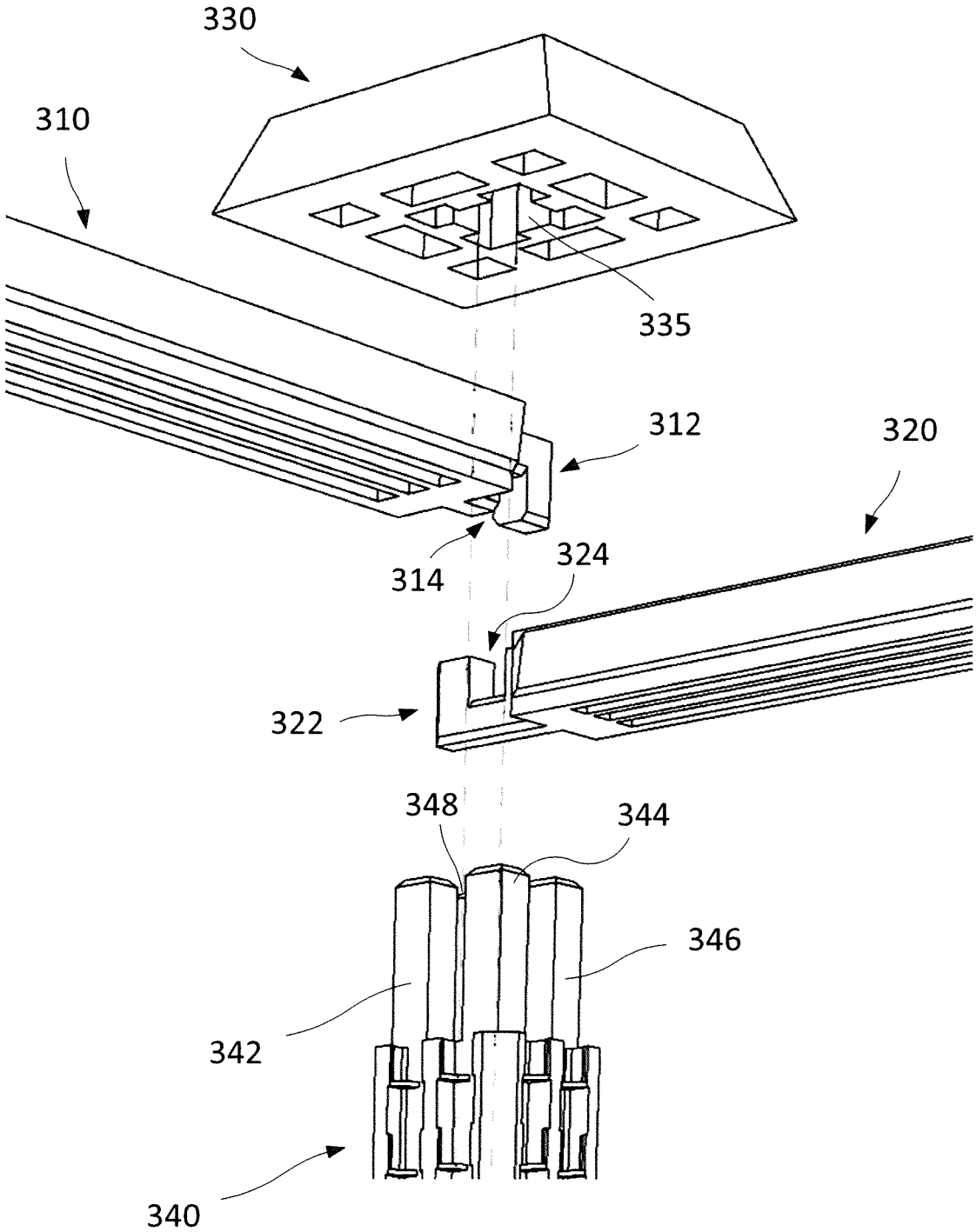
FIG. 3 depicts aspects of a modular assembly shelter kit according to certain embodiments of the invention.

FIG. 3 illustrates how a first upper horizontal beam 310, a second horizontal upper beam 320, a header 330, and a vertical support column 340 can be cooperatively engaged. First upper horizontal beam 310 includes a hook 312 with a downward facing notch 314. Conversely, second upper horizontal beam 320 includes a hook 322 with an upward facing notch 324. As discussed elsewhere herein, downward facing notch 314 and upward facing notch 324 can interlock so that hook 312 and hook 322 form an upper cross joint. The upper cross joint can be disposed below header 330, and vertical support column 340 can operate to cage the upper cross joint when a first upper prong 342 of vertical support column 340 is inserted in an opening or channel of header 330, a second upper prong 344 of vertical support column 340 is inserted in an opening or channel of header 330, a third upper prong 346 of vertical support column 340 is inserted in an opening or channel of header 330, and a fourth upper prong 348 of vertical support column 340 is inserted in an opening or channel of header 330. For example, the upper prongs of vertical support column 340 can be inserted into or received by a central aperture 335 of header 330. As shown here, central aperture 335 includes four channels for receiving four prongs, similar to the configuration depicted in FIG. 28.

Figure 4:
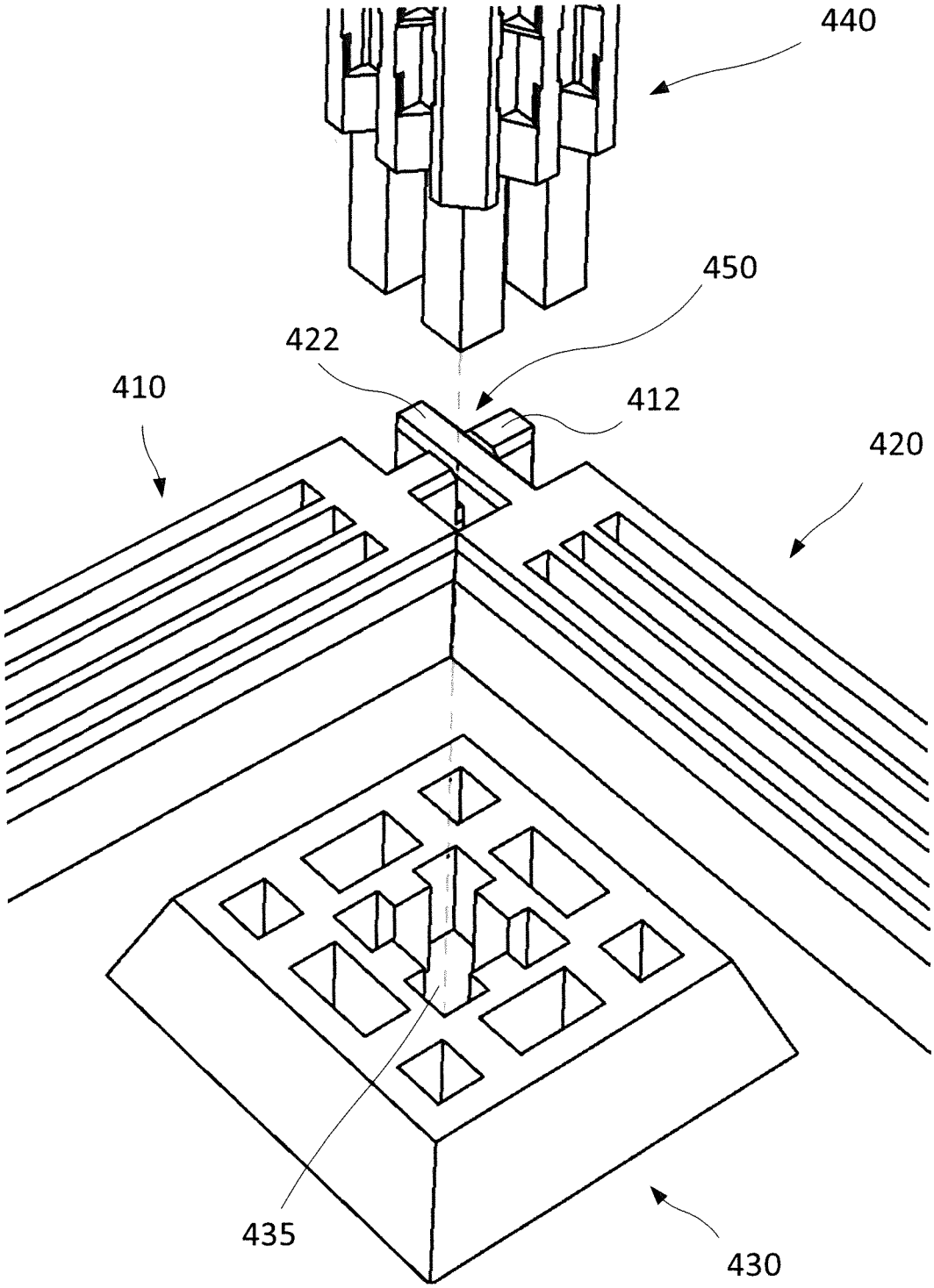
FIG. 4 depicts aspects of a modular assembly shelter kit according to certain embodiments of the invention.

FIG. 4 depicts an analogous situation, where respective notches of a first lower horizontal beam 410 and a second lower horizontal beam 420 are interlocked, so that the respective hooks 412, 422 of the beams 410, 420 form a lower cross joint 450. Vertical support column 440 can engage both beams 410, 420 as well as a footer 430. A central aperture 435 of footer 430 includes four channels for receiving four prongs, similar to the configuration depicted in FIG. 2B.

Figure 5:
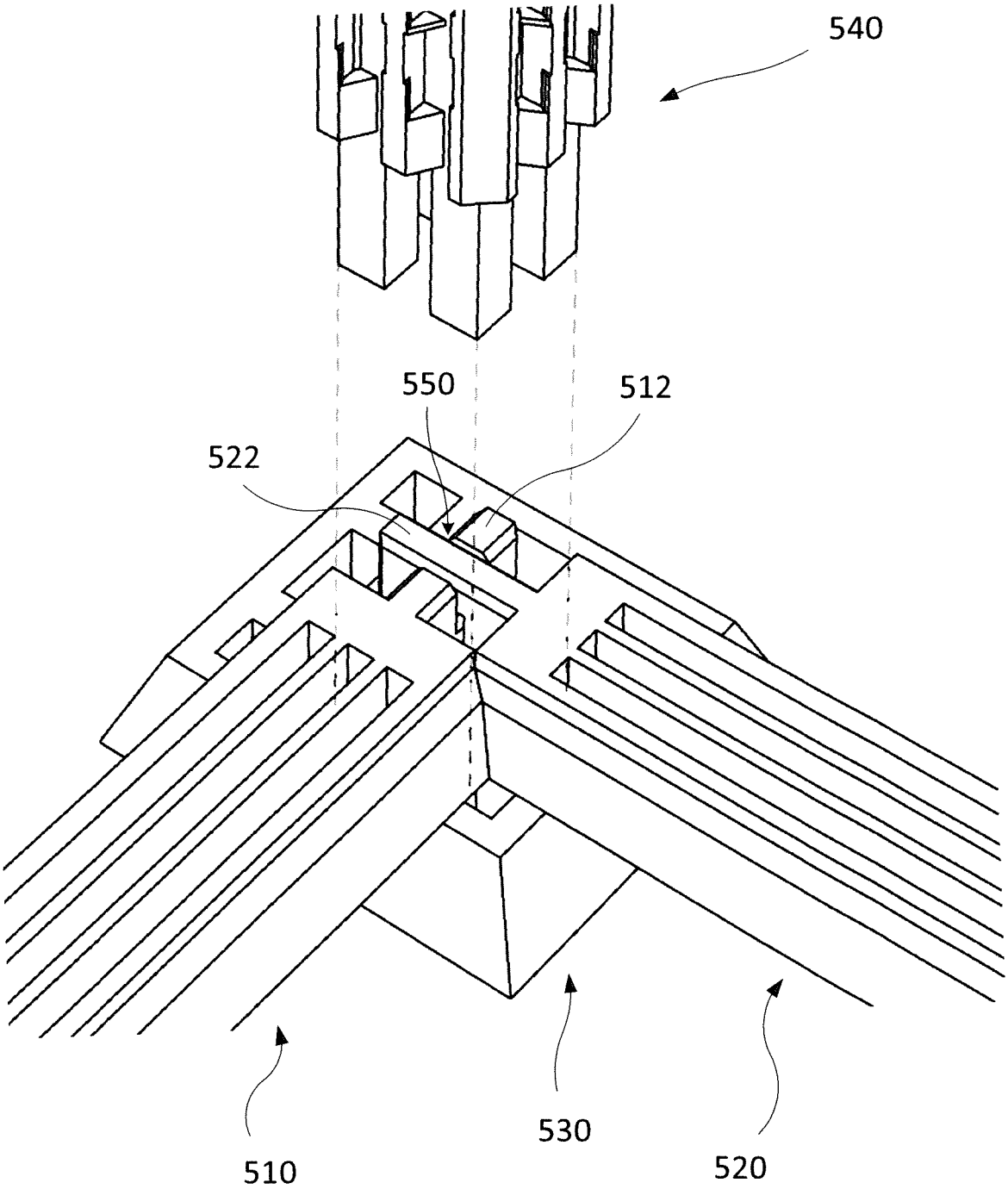
FIG. 5 depicts aspects of a modular assembly shelter kit according to certain embodiments of the invention.

As shown in FIG. 5, a first lower horizontal beam 510 and a second lower horizontal beam 520, as well as a lower cross joint 550 formed by hook 512 of beam 510 and hook 522 of beam 520, can be disposed above or positioned upon a footer 530, Prongs of a vertical support column 540 can be inserted into openings or channels of footer 530, and the prongs can operate to cage lower cross joint 550.

FIG. 6A depicts an upper horizontal beam 610 according to embodiments of the present invention. As shown here, upper horizontal beam 610 includes a first hook 612 having a first downward facing notch 614, and a second hook 622 having a second downward facing notch 624. Upper horizontal beam 610 also includes an interior groove 630 and an exterior groove 632. In some cases, upper horizontal beam 610 can include an intermediate groove 634 disposed between interior groove 630 and exterior groove 632. Upper horizontal beam 610 also includes an interior ledge 636. FIG. 6B depicts a lower horizontal beam 650 according to embodiments of the present invention. As shown here, upper horizontal beam 650 includes a first hook 652 having a first downward facing notch 654, and a second hook 662 having a second downward facing notch 664. Lower horizontal beam 650 also includes an interior groove 670 and an exterior groove 672. In some cases, upper horizontal beam 650 can include an intermediate groove 674 disposed between interior groove 670 and exterior groove 672. Upper horizontal beam 650 also includes an interior ledge 676. FIG. 6C depicts an end view of a lower horizontal beam 680 according to embodiments of the present invention. As shown here, lower horizontal beam 680 includes an interior ledge 686. The thickness of ledge 686, the distance between ledge 686 and the upper surface of beam 680, and the distance between ledge 686 and the lower surface of beam 680 can each be selected, so as to accommodate any variety of thicknesses for the roof and/or floor panels. In some cases, a floor panel and/or a roof panel can be flat or planar. In some cases, a floor panel and/or a roof panel can be non-planar, which can improve run-off of snow and rain with respect to the roof, and which can improve load-bearing performance with respect to the floor.

Figure 7A:
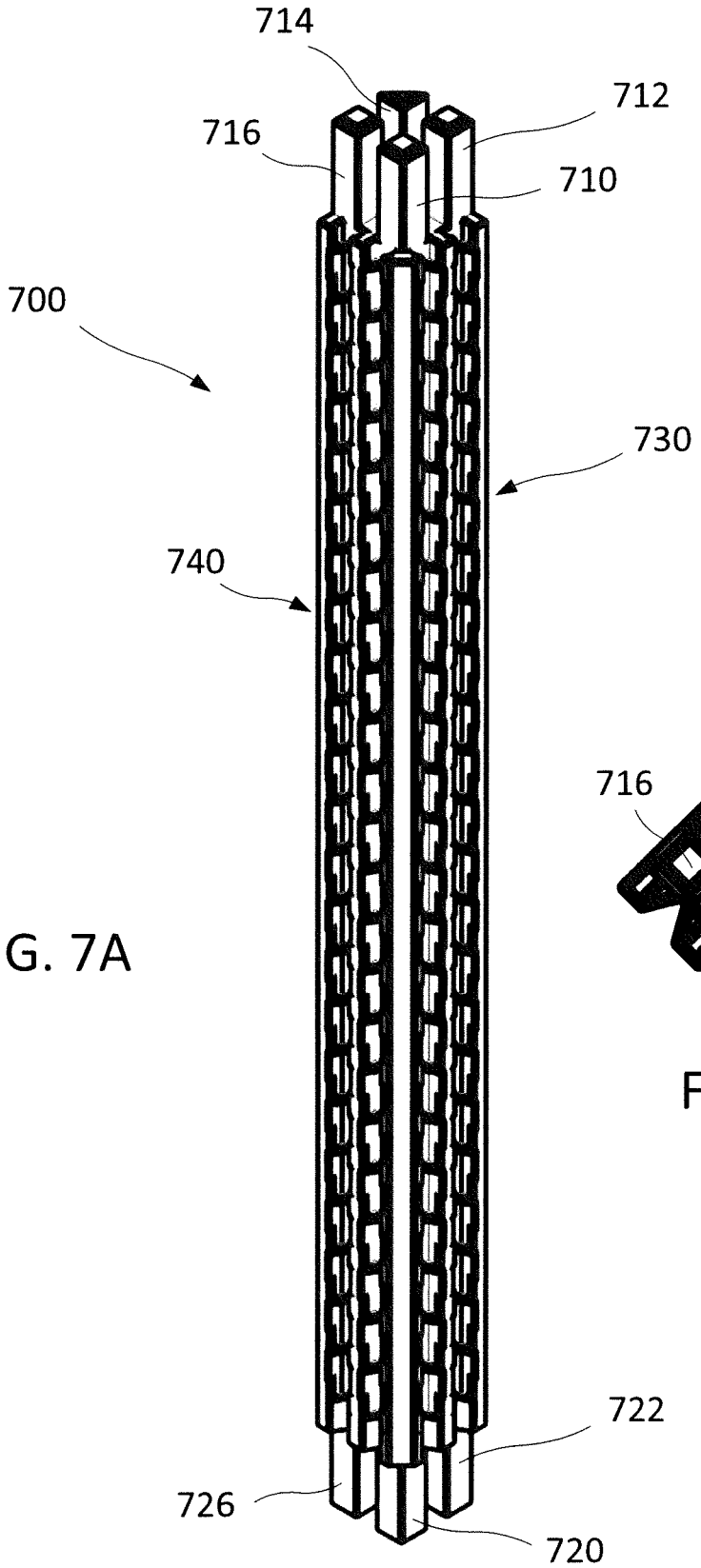
FIG. 7A depicts aspects of a vertical support column according to certain embodiments of the invention.
Figure 7B:
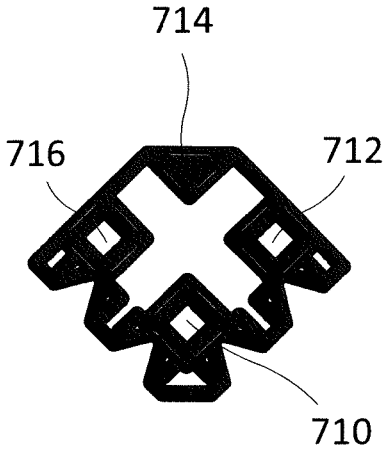
FIG. 7B depicts aspects of a vertical support column according to certain embodiments of the invention.

FIG. 7A depicts aspects of a vertical support column 700 according to embodiments of the present invention. As shown here, column 700 includes has a first upper prong 710, a second upper prong 712, a third upper prong 714, a fourth upper prong 716, a first lower prong 720, a second lower prong 722, a third lower prong (not shown), a fourth lower prong 726, a first engagement mechanism 730, and a second engagement mechanism 740. As shown in the top plan view of FIG. 7B, the first (e.g. 710), second (e.g. 712), and fourth (e.g. 716) prongs have a square cross-section, and the third (e.g. 714) prongs have a triangle cross section.

Figure 8:
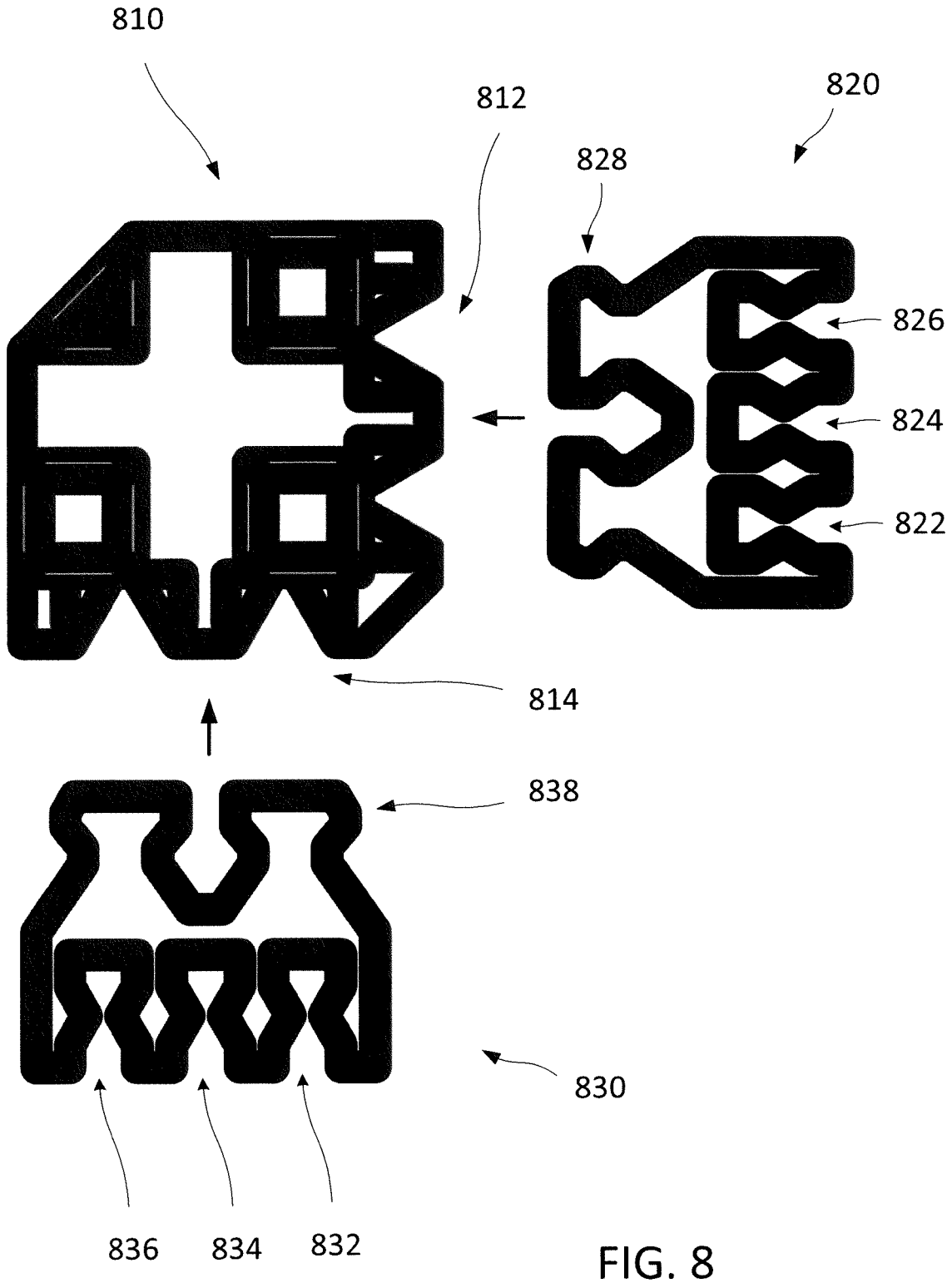
FIG. 8 depicts aspects of a vertical support column and two vertical couplers according to certain embodiments of the invention.

FIG. 8 depicts a top plan view of a vertical support column 810, a first vertical coupler 820, and a second vertical coupler 830. As shown here, the vertical support column 810 has a first engagement mechanism 812 and a second engagement mechanism 814. The first vertical coupler 820 has an interior groove 822, an intermediate groove 824, an exterior groove 826, and an engagement mechanism 828. The second vertical coupler 830 has an interior groove 832, an intermediate groove 834, an exterior groove 836, and an engagement mechanism 838. First engagement mechanism 812 of column 810 is configured to engage with engagement mechanism 828 of first coupler 820, and second engagement mechanism 814 of column 810 is configured to engage with engagement mechanism 838 of second coupler 830.

Figure 9:
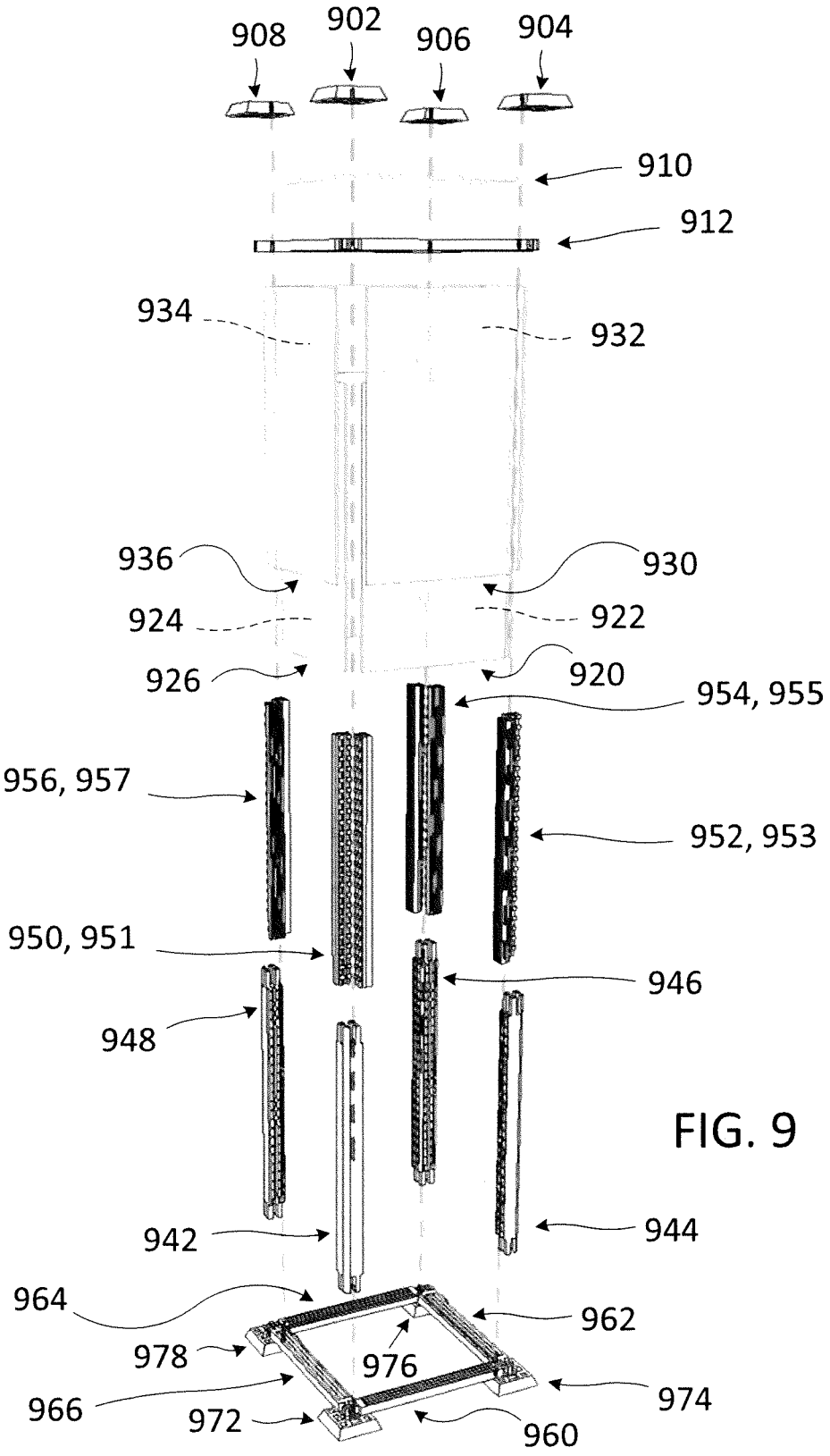
FIG. 9 depicts aspects of a modular assembly shelter kit according to certain embodiments of the invention.

FIG. 9 depicts an exploded perspective view of a modular assembly shelter kit 900, according to embodiments of the present invention. As shown here, modular assembly shelter kit 900 includes a first header 902, a second header 904, a third header 906, a fourth header 908, an upper panel 910, one or more upper horizontal beams 912, a first interior wall panel 920, a second interior wall panel 922, a third interior wall panel 924, a fourth interior wall panel 926, a first exterior wall panel 930, a second exterior wall panel 932, a third exterior wall panel 934, a fourth exterior wall panel 936, a first vertical support column 942, a second vertical support column 944, a third vertical support column 946, and a fourth vertical support column 948. Modular assembly shelter kit 900 also includes a first vertical coupler 950, a second vertical coupler 951, a third vertical coupler 952, a fourth vertical coupler 953, a fifth vertical coupler 954, a sixth vertical coupler 955, a seventh vertical coupler 956, and an eighth vertical coupler 957. Further, modular assembly shelter kit 900 includes a first lower horizontal beam 960, a second lower horizontal beam 962, a third lower horizontal beam 964, a fourth lower horizontal beam 966, a lower panel (not shown), a first footer 972, a second footer 974, a third footer 976, and a fourth footer 978.

Figure 10:
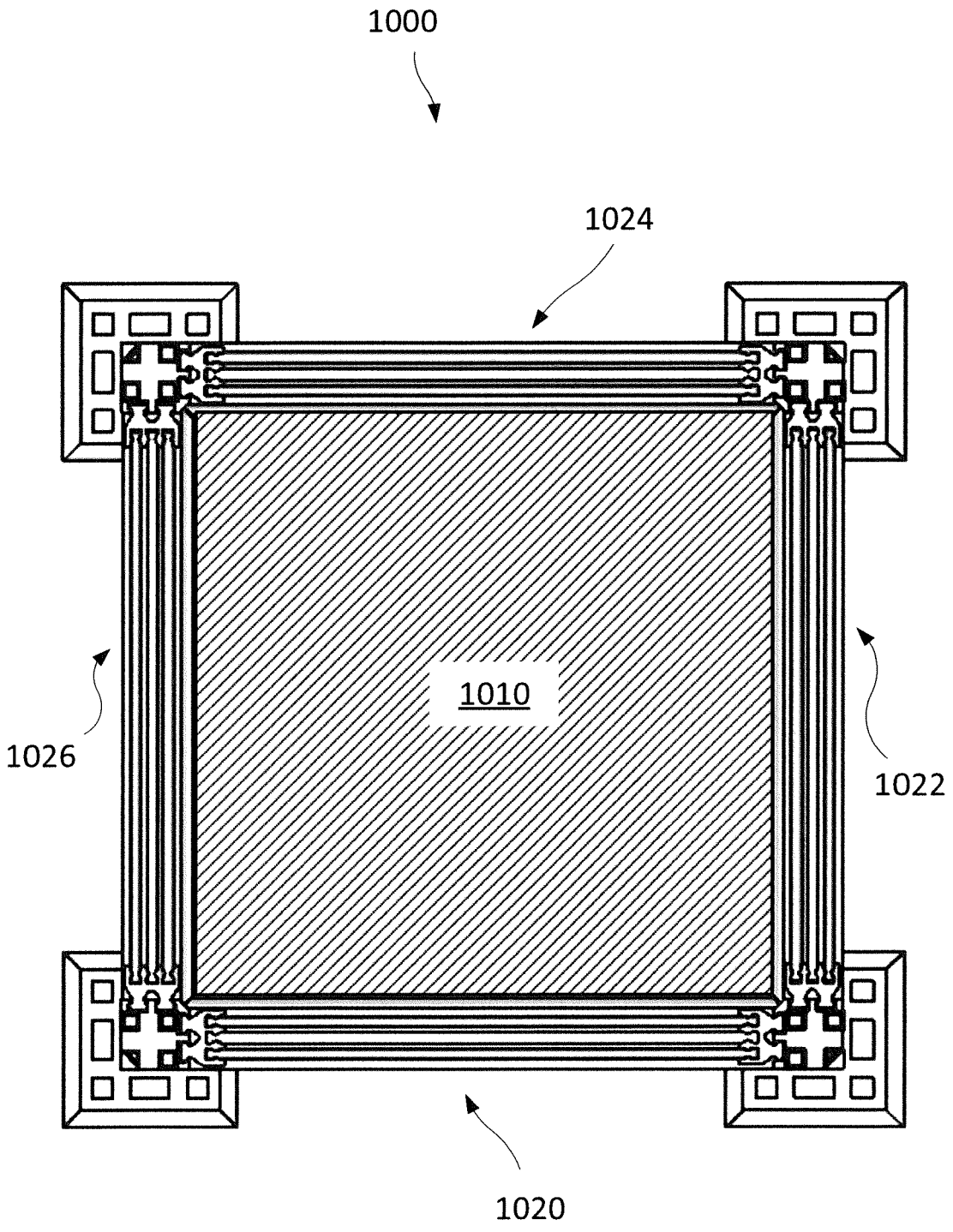
FIG. 10 depicts aspects of a modular assembly shelter kit according to certain embodiments of the invention.

FIG. 10 shows a cut-away top plan view of a modular assembly shelter kit 1000 according to embodiments of the present invention. As depicted here, modular assembly shelter kit 1000 can include a lower panel 1010 that is supported by a first lower horizontal beam 1020, a second lower horizontal beam 1022, a third lower horizontal beam 1024, and a fourth lower horizontal beam 1026.

Figure 11:
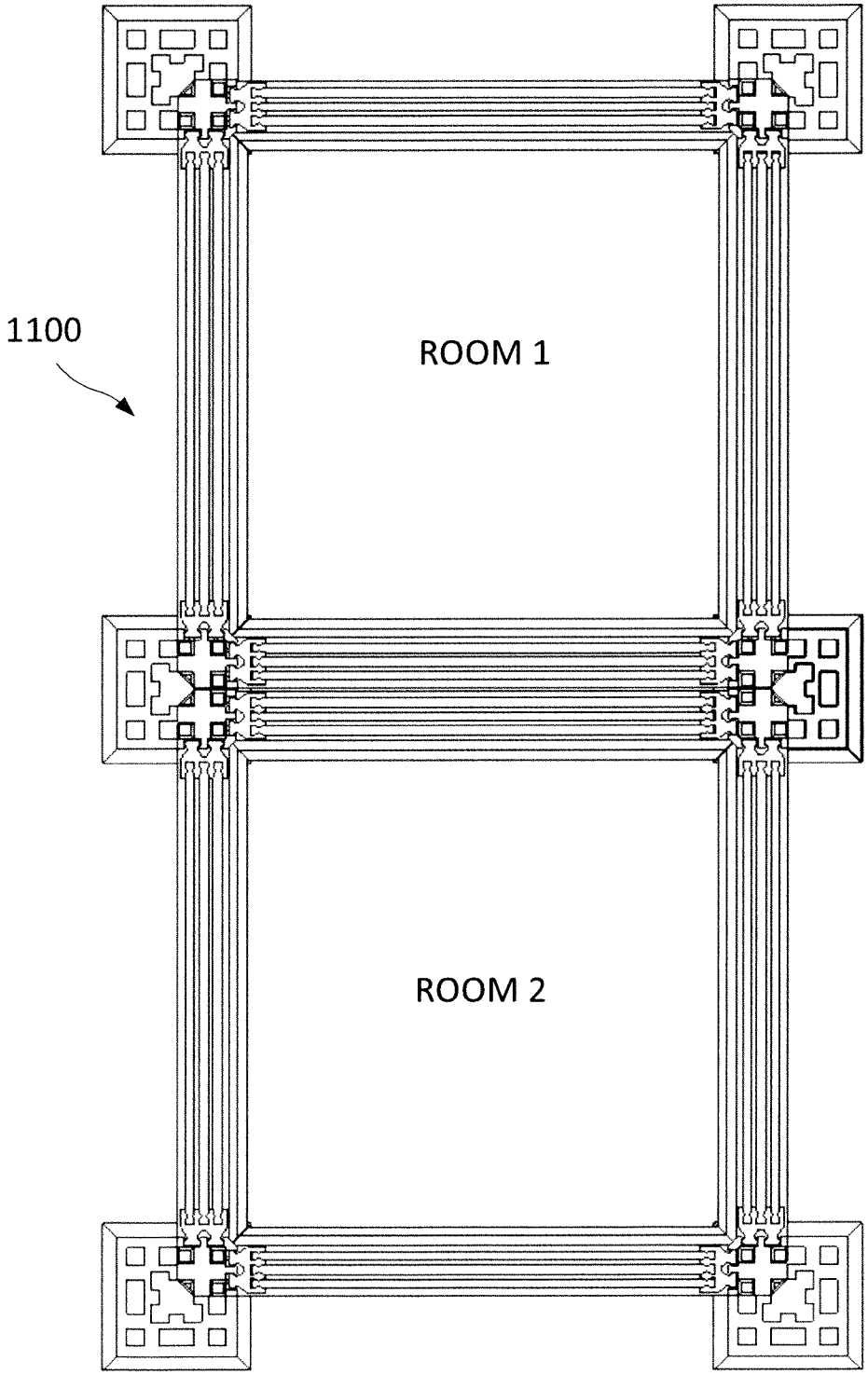
FIG. 11 depicts aspects of a multi-room modular assembly shelter kit according to certain embodiments of the invention.
Figure 12:
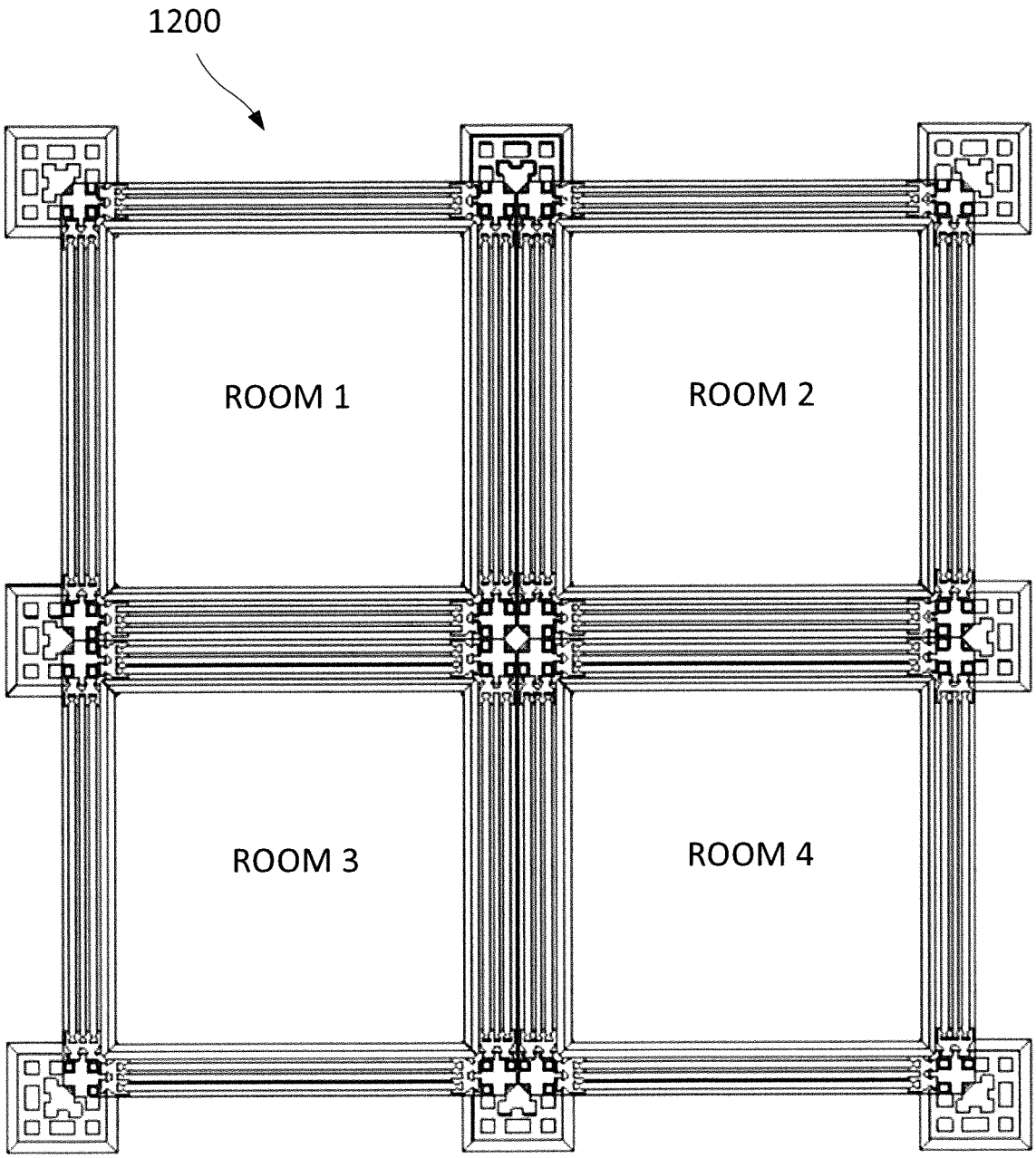
FIG. 12 depicts aspects of a multi-room modular assembly shelter kit according to certain embodiments of the invention.

By combining kit elements in various configurations, it is possible to construct shelters have any number of desired rooms. For example, FIG. 11 depicts a cut-away top plan view of a shelter kit 1100 that provides two rooms (room 1, room 2). Similarly, FIG. 12 depicts a cut-away top plan view of a shelter kit 1200 that provides four rooms (room 1, room 2, room 3, room 4). The footer exterior placement depicted in FIGS. 11 and 12 (e.g. as compared to the footer central placement depicted in FIG. 10) is configured so that additional kits can be added. In contrast, in some embodiments, the footers can be placed relative to the vertical support columns so that all or a majority of the footer is disposed within the room and/or under the panel walls. Such footer interior placement configurations would then not allow for expansion of the shelter with additional kits. Any desired combination of footer and/or header interior/exterior/central placements relative to the vertical support columns (e.g. as discussed herein with reference to FIGS. 2B and 2C) can be implemented using the kit components disclosed herein.

Figure 13:
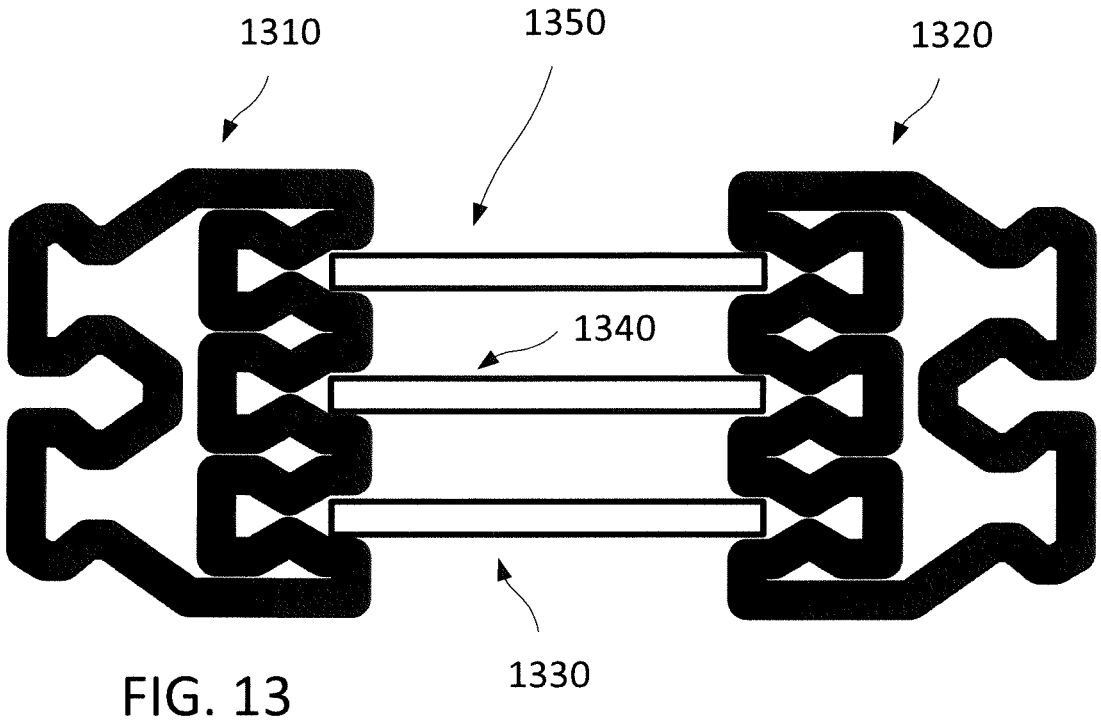
FIG. 13 depicts aspects of a wall assembly of a multi-room modular assembly shelter kit according to certain embodiments of the invention.
Figure 14:
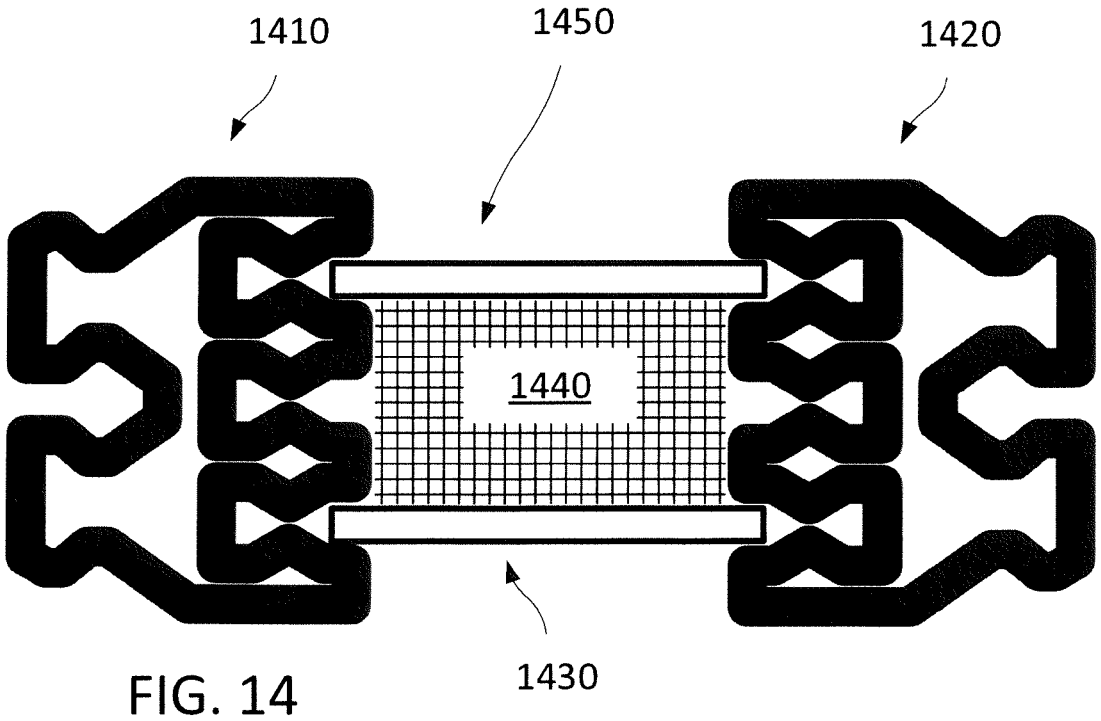
FIG. 14 depicts aspects of a wall assembly of a multi-room modular assembly shelter kit according to certain embodiments of the invention.

According to some embodiments, multiple wall panels can be engaged between the vertical couplers. For example, as shown in FIG. 13, first vertical coupler 1310 and second vertical coupler 1320 operate to hold or secure an interior wall panel 1330, an intermediate wall panel 1340, and an exterior wall panel 1350. According to some embodiments, fill material (e.g. dirt or sand) can be placed between wall panels. For example, as shown in FIG. 14, first vertical coupler 1410 and second vertical coupler 1420 operate to hold or secure an interior wall panel 1430 and an exterior wall panel 1450, and a fill material 1440 is disposed between interior wall panel 1430 and exterior wall panel 1450. Although FIGS. 13 and 14 depict the panels as inserted partially within the recesses or channels of the vertical couplers, it is appreciated that panels can also be inserted fully into the recesses or channels as well.

Exemplary Embodiments

This application discloses the novel utility of modular assembly shelter kits that can be constructed using gravity loaded joinery techniques, without requiring bolts or fasteners. Exemplary kit embodiments provide users with the ability to expand a shelter by adding more kits, due to the use of innovative geometries for modular designs. According to some embodiments, the components of a kit are designed so that the kit has the least amount of custom parts. For example, the floor (e.g. horizontal lower) and roof (e.g. horizontal upper) beams can have the same shape or design. Similarly, the footers and headers can have the same shape or design. Individual kit component parts are designed to be easily exchanged when broken or damaged, without requiring replacement of a whole kit. Kit components can be additively manufactured with minimal support material. Kit embodiments that include multiple wall panels with and infill approach allows for customization of the end goal of the shelter (i.e. thermal storage or ballistic protection).

In one aspect, embodiments of the present invention encompass a modular assembly shelter kit that includes a header, a first upper horizontal beam having an interior groove, an exterior groove, an interior ledge, and a hook with an upward facing notch, a second upper horizontal beam having an interior groove, an exterior groove, an interior ledge, and a hook with a downward facing notch, a roof panel, a vertical support column, an interior wall panel, an exterior wall panel, a first lower horizontal beam having an interior groove, an exterior groove, an interior ledge, and a hook with an upward facing notch, a second lower horizontal beam having an interior groove, an exterior groove, an interior ledge, and a hook with a downward facing notch, a floor panel, and a footer. The vertical support column can include a plurality of upper prongs and a plurality of lower prongs. The notch of the first upper horizontal beam and the notch of the second upper horizontal beam can interlock so that the hook of the first upper horizontal beam and the hook of the second upper horizontal beam form an upper cross joint. The upper cross joint can be disposed below the header. The vertical support column can operate to cage the upper cross joint when the plurality of upper prongs of the vertical support column engage the header. The notch of the first lower horizontal beam and the notch of the second lower horizontal beam can interlock so that the hook of the first lower horizontal beam and the hook of the second lower horizontal beam form a lower cross joint. The lower cross joint can be disposed above the footer. The vertical support column can operate to cage the lower cross joint when the plurality of lower prongs of the vertical support column engage the footer. The roof panel can be disposed above the interior ledge of the first upper horizontal beam and the interior ledge of the second upper horizontal beam, and the floor panel can be disposed above the interior ledge of the first lower horizontal beam and the interior ledge of the second lower horizontal beam. The interior wall panel can be engaged with the interior groove of the first upper horizontal beam or the interior groove of the second upper horizontal beam, and with the interior groove of the first lower horizontal beam or the interior groove of the second lower horizontal beam. The exterior wall panel can be engaged with the exterior groove of the first upper horizontal beam or the exterior groove of the second upper horizontal beam, and with the exterior groove of the first lower horizontal beam or the exterior groove of the second lower horizontal beam.

In some cases, the interior wall panel is engaged with the interior groove of the first upper horizontal beam and the interior groove of the first lower horizontal beam. In some cases, the interior wall panel is engaged with the interior groove of the first upper horizontal beam and the interior groove of the second lower horizontal beam. In some cases, the interior wall panel is engaged with the interior groove of the second upper horizontal beam and the interior groove of the first lower horizontal beam. In some cases, the interior wall panel is engaged with the interior groove of the second upper horizontal beam and the interior groove of the second lower horizontal beam. In some cases, the exterior wall panel is engaged with the exterior groove of the first upper horizontal beam and the exterior groove of the first lower horizontal beam. In some cases, the exterior wall panel is engaged with the exterior groove of the first upper horizontal beam and the exterior groove of the second lower horizontal beam. In some cases, the exterior wall panel is engaged with the exterior groove of the second upper horizontal beam and the exterior groove of the first lower horizontal beam. In some cases, the exterior wall panel is engaged with the exterior groove of the second upper horizontal beam and the exterior groove of the second lower horizontal beam.

In another aspect, embodiments of the present invention encompass a modular assembly shelter kit that includes a header having a central opening with four channels, a first upper horizontal beam having an interior groove, an exterior groove, an interior ledge, and a hook with an upward facing notch, a second upper horizontal beam having an interior groove, an exterior groove, an interior ledge, and a hook with a downward facing notch, a roof panel, a vertical support column having four upper prongs and four lower prongs, an interior wall panel, an exterior wall panel, a first lower horizontal beam having an interior groove, an exterior groove, an interior ledge, and a hook with an upward facing notch, a second lower horizontal beam having an interior groove, an exterior groove, an interior ledge, and a hook with a downward facing notch, a floor panel, and a footer having a central opening with four channels. The notch of the first upper horizontal beam and the notch of the second upper horizontal beam can interlock so that the hook of the first upper horizontal beam and the hook of the second upper horizontal beam form an upper cross joint. The upper cross joint can be disposed below the header, and the vertical support column can operate to cage the upper cross joint when each of the four upper prongs of the vertical support column are inserted within respective channels of the header. The notch of the first lower horizontal beam and the notch of the second lower horizontal beam can interlock so that the hook of the first lower horizontal beam and the hook of the second lower horizontal beam form a lower cross joint. The lower cross joint can be disposed above the footer, and the vertical support column can operate to cage the lower cross joint when each of the four lower prongs of the vertical support column are inserted within respective channels of the footer. The roof panel can be disposed above the interior ledge of the first upper horizontal beam and the interior ledge of the second upper horizontal beam. The floor panel can be disposed above the interior ledge of the first lower horizontal beam and the interior ledge of the second lower horizontal beam. The interior wall panel can be engaged with the interior groove of the first upper horizontal beam or the interior groove of the second upper horizontal beam. The interior wall panel can be engaged with the interior groove of the first lower horizontal beam or the interior groove of the second lower horizontal beam. The exterior wall panel can be engaged with the exterior groove of the first upper horizontal beam or the exterior groove of the second upper horizontal beam. The exterior wall panel can be engaged with the exterior groove of the first lower horizontal beam or the exterior groove of the second lower horizontal beam.

In some cases, the interior wall panel is engaged with the interior groove of the first upper horizontal beam and the interior groove of the first lower horizontal beam. In some cases, the interior wall panel is engaged with the interior groove of the first upper horizontal beam and the interior groove of the second lower horizontal beam. In some cases, the interior wall panel is engaged with the interior groove of the second upper horizontal beam and the interior groove of the first lower horizontal beam. In some cases, the interior wall panel is engaged with the interior groove of the second upper horizontal beam and the interior groove of the second lower horizontal beam. In some cases, the exterior wall panel is engaged with the exterior groove of the first upper horizontal beam and the exterior groove of the first lower horizontal beam. In some cases, the exterior wall panel is engaged with the exterior groove of the first upper horizontal beam and the exterior groove of the second lower horizontal beam. In some cases, the exterior wall panel is engaged with the exterior groove of the second upper horizontal beam and the exterior groove of the first lower horizontal beam. In some cases, the exterior wall panel is engaged with the exterior groove of the second upper horizontal beam and the exterior groove of the second lower horizontal beam.

In yet another aspect, embodiments of the present invention encompass a modular assembly shelter kit that includes a first header, a second header, a third header, and a fourth header, an upper panel, a first upper horizontal beam, a second upper horizontal beam, a third upper horizontal beam, and a fourth upper horizontal beam, a first interior wall panel, a second interior wall panel, a third interior wall panel, and a fourth interior wall panel, a first exterior wall panel, a second exterior wall panel, a third exterior wall panel, and a fourth exterior wall panel, a first vertical support column, a second vertical support column, a third vertical support column, and a fourth vertical support column, a first vertical coupler, a second vertical coupler, a third vertical coupler, a fourth vertical coupler, a fifth vertical coupler, a sixth vertical coupler, a seventh vertical coupler, and an eighth vertical coupler, a first lower horizontal beam, a second lower horizontal beam, a third lower horizontal beam, and a fourth lower horizontal beam, a lower panel, and a first footer, a second footer, a third footer, and a fourth footer.

In some cases, the first header has a first channel, a second channel, a third channel, and a fourth channel, the second header has a first channel, a second channel, a third channel, and a fourth channel, the third header has a first channel, a second channel, a third channel, and a fourth channel, and the fourth header has a first channel, a second channel, a third channel, and a fourth channel.

In some cases, the first upper horizontal beam has a first hook with a first upward facing notch, a second hook with a second upward facing notch, an interior groove, an exterior groove, and an interior ledge, the second upper horizontal beam has a first hook with a first downward facing notch, a second hook with a second downward facing notch, an interior groove, an exterior groove, and an interior ledge, the third upper horizontal beam has a first hook with a first upward facing notch, a second hook with a second upward facing notch, an interior groove, an exterior groove, and an interior ledge, and the fourth upper horizontal beam has a first hook with a first downward facing notch, a second hook with a second downward facing notch, an interior groove, an exterior groove, and an interior ledge.

In some cases, the first vertical support column has a first upper prong, a second upper prong, a third upper prong, a fourth upper prong, a first lower prong, a second lower prong, a third lower prong, a fourth lower prong, a first engagement mechanism, and a second engagement mechanism.

In some cases, the second vertical support column has a first upper prong, a second upper prong, a third upper prong, a fourth upper prong, a first lower prong, a second lower prong, a third lower prong, a fourth lower prong, a first engagement mechanism, and a second engagement mechanism.

In some cases, the third vertical support column has a first upper prong, a second upper prong, a third upper prong, a fourth upper prong, a first lower prong, a second lower prong, a third lower prong, a fourth lower prong, a first engagement mechanism, and a second engagement mechanism.

In some cases, the fourth vertical support column has a first upper prong, a second upper prong, a third upper prong, a fourth upper prong, a first lower prong, a second lower prong, a third lower prong, a fourth lower prong, a first engagement mechanism, and a second engagement mechanism.

In some cases, the first vertical coupler has an interior groove, an exterior groove, and an engagement mechanism, the second vertical coupler has an interior groove, an exterior groove, and an engagement mechanism, the third vertical coupler has an interior groove, an exterior groove, and an engagement mechanism, the fourth vertical coupler has an interior groove, an exterior groove, and an engagement mechanism, the fifth vertical coupler has an interior groove, an exterior groove, and an engagement mechanism, the sixth vertical coupler has an interior groove, an exterior groove, and an engagement mechanism, the seventh vertical coupler has an interior groove, an exterior groove, and an engagement mechanism, and the eighth vertical coupler has an interior groove, an exterior groove, and an engagement mechanism.

In some cases, the first lower horizontal beam has a first hook with a first upward facing notch, a second hook with an upward facing notch, an interior groove, an exterior groove, and an interior ledge, the second lower horizontal beam has a first hook with a first downward facing notch, a second hook with a second downward facing notch, an interior groove, an exterior groove, and an interior ledge, the third lower horizontal beam has a first hook with a first upward facing notch, a second hook with a second upward facing notch, an interior groove, an exterior groove, and an interior ledge, and the fourth lower horizontal beam has a first hook with a first downward facing notch, a second hook with a second downward facing notch, an interior groove, an exterior groove, and an interior ledge.

In some cases, the first footer has a first channel, a second channel, a third channel, and a fourth channel, the second footer has a first channel, a second channel, a third channel, and a fourth channel, the third footer has a first channel, a second channel, a third channel, and a fourth channel, and the fourth footer has a first channel, a second channel, a third channel, and a fourth channel.

In some cases, the first notch of the first upper horizontal beam and the second notch of the fourth upper horizontal beam interlock so that the first hook of the first upper horizontal beam and the second hook of the fourth upper horizontal beam form a first upper cross joint.

In some cases, the second notch of the first upper horizontal beam and the first notch of the second upper horizontal beam interlock so that the second hook of the first upper horizontal beam and the first hook of the second upper horizontal beam form a second upper cross joint.

In some cases, the second notch of the second upper horizontal beam and the first notch of the third upper horizontal beam interlock so that the second hook of the second upper horizontal beam and the first hook of the third upper horizontal beam form a third upper cross joint.

In some cases, the second notch of the third upper horizontal beam and the first notch of the fourth upper horizontal beam interlock so that the second hook of the third upper horizontal beam and the first hook of the fourth upper horizontal beam form a fourth upper cross joint.

In some cases, the first notch of the first lower horizontal beam and the second notch of the fourth lower horizontal beam interlock so that the first hook of the first lower horizontal beam and the second hook of the fourth lower horizontal beam form a first lower cross joint.

In some cases, the second notch of the first lower horizontal beam and the first notch of the second lower horizontal beam interlock so that the second hook of the first lower horizontal beam and the first hook of the second lower horizontal beam form a second lower cross joint.

In some cases, the second notch of the second lower horizontal beam and the first notch of the third lower horizontal beam interlock so that the second hook of the second lower horizontal beam and the first hook of the third lower horizontal beam form a third lower cross joint.

In some cases, the second notch of the third lower horizontal beam and the first notch of the fourth lower horizontal beam interlock so that the second hook of the third lower horizontal beam and the first hook of the fourth lower horizontal beam form a fourth lower cross joint.

In some cases, the first lower cross joint is disposed above the first footer, and the first vertical support column cages the first lower cross joint when the first lower prong of the first vertical support column is inserted in the first channel of the first footer, the second lower prong of the first vertical support column is inserted in the second channel of the first footer, the third lower prong of the first vertical support column is inserted in the third channel of the first footer, and the fourth lower prong of the first vertical support column is inserted in the fourth channel of the first footer.

In some cases, the second lower cross joint is disposed above the second footer, and the second vertical support column cages the second lower cross joint when the first lower prong of the second vertical support column is inserted in the first channel of the second footer, the second lower prong of the second vertical support column is inserted in the second channel of the second footer, the third lower prong of the second vertical support column is inserted in the third channel of the second footer, and the fourth lower prong of the second vertical support column is inserted in the fourth channel of the second footer.

In some cases, the third lower cross joint is disposed above the third footer, and the third vertical support column cages the third lower cross joint when the first lower prong of the third vertical support column is inserted in the first channel of the third footer, the second lower prong of the third vertical support column is inserted in the second channel of the third footer, the third lower prong of the third vertical support column is inserted in the third channel of the third footer, and the fourth lower prong of the third vertical support column is inserted in the fourth channel of the third footer.

In some cases, the fourth lower cross joint is disposed above the fourth footer, and the fourth vertical support column cages the fourth lower cross joint when the first lower prong of the fourth vertical support column is inserted in the first channel of the fourth footer, the second lower prong of the fourth vertical support column is inserted in the second channel of the fourth footer, the third lower prong of the fourth vertical support column is inserted in the third channel of the fourth footer, and the fourth lower prong of the fourth vertical support column is inserted in the fourth channel of the fourth footer.

In some cases, the engagement mechanism of the first coupler attaches with the first engagement mechanism of the first vertical support column, the engagement mechanism of the second coupler attaches with the second engagement mechanism of the second vertical support column, the engagement mechanism of the third coupler attaches with the first engagement mechanism of the second vertical support column, the engagement mechanism of the fourth coupler attaches with the second engagement mechanism of the third vertical support column, the engagement mechanism of the fifth coupler attaches with the first engagement mechanism of the third vertical support column, the engagement mechanism of the sixth coupler attaches with the second engagement mechanism of the fourth vertical support column, the engagement mechanism of the seventh coupler attaches with the first engagement mechanism of the fourth vertical support column, and the engagement mechanism of the eighth coupler attaches with the second engagement mechanism of the first vertical support column.

In some cases, the first upper cross joint is disposed below the first header, and the first vertical support column cages the first upper cross joint when the first upper prong of the first vertical support column is inserted in the first channel of the first header, the second upper prong of the first vertical support column is inserted in the second channel of the first header, the third upper prong of the first vertical support column is inserted in the third channel of the first header, and the fourth upper prong of the first vertical support column is inserted in the fourth channel of the first header.

In some cases, the second upper cross joint is disposed below the second header, and the second vertical support column cages the second upper cross joint when the first upper prong of the second vertical support column is inserted in the first channel of the second header, the second upper prong of the second vertical support column is inserted in the second channel of the second header, the third upper prong of the second vertical support column is inserted in the third channel of the second header, and the fourth upper prong of the second vertical support column is inserted in the fourth channel of the second header.

In some cases, the third upper cross joint is disposed below the third header, and the third vertical support column cages the third upper cross joint when the first upper prong of the third vertical support column is inserted in the first channel of the third header, the second upper prong of the third vertical support column is inserted in the second channel of the third header, the third upper prong of the third vertical support column is inserted in the third channel of the third header, and the fourth upper prong of the third vertical support column is inserted in the fourth channel of the third header.

In some cases, the fourth upper cross joint is disposed below the fourth header, and the fourth vertical support column cages the fourth upper cross joint when the first upper prong of the fourth vertical support column is inserted in the first channel of the fourth header, the second upper prong of the fourth vertical support column is inserted in the second channel of the fourth header, the third upper prong of the fourth vertical support column is inserted in the third channel of the fourth header, and the fourth upper prong of the fourth vertical support column is inserted in the fourth channel of the fourth header.

In some cases, the first interior wall panel is secured by the interior groove of the first coupler, the interior groove of the second coupler, the interior groove of the first upper horizontal beam, and the interior groove of the first lower horizontal beam.

In some cases, the second interior wall panel is secured by the interior groove of the third coupler, the interior groove of the fourth coupler, the interior groove of the second upper horizontal beam, and the interior groove of the second lower horizontal beam.

In some cases, the third interior wall panel is secured by the interior groove of the fifth coupler, the interior groove of the sixth coupler, the interior groove of the third upper horizontal beam, and the interior groove of the third lower horizontal beam.

In some cases, the fourth interior wall panel is secured by the interior groove of the seventh coupler, the interior groove of the eighth coupler, the interior groove of the fourth upper horizontal beam, and the interior groove of the fourth lower horizontal beam.

In some cases, the first exterior wall panel is secured by the exterior groove of the first coupler, the exterior groove of the second coupler, the exterior groove of the first upper horizontal beam, and the exterior groove of the first lower horizontal beam.

In some cases, the second exterior wall panel is secured by the exterior groove of the third coupler, the exterior groove of the fourth coupler, the exterior groove of the second upper horizontal beam, and the exterior groove of the second lower horizontal beam.

In some cases, the third exterior wall panel is secured by the exterior groove of the fifth coupler, the exterior groove of the sixth coupler, the exterior groove of the third upper horizontal beam, and the exterior groove of the third lower horizontal beam.

In some cases, the fourth exterior wall panel is secured by the exterior groove of the seventh coupler, the exterior groove of the eighth coupler, the exterior groove of the fourth upper horizontal beam, and the exterior groove of the fourth lower horizontal beam.

In some cases, the upper panel is disposed upon the interior ledge of the first upper horizontal beam, the interior ledge of the second upper horizontal beam, the interior ledge of the third upper horizontal beam, and the interior ledge of the fourth upper horizontal beam.

In some cases, the lower panel is disposed upon the interior ledge of the first lower horizontal beam, the interior ledge of the second lower horizontal beam, the interior ledge of the third lower horizontal beam, and the interior ledge of the fourth lower horizontal beam.

According to some embodiments, a modular assembly shelter kit can further include a first intermediate wall panel disposed between the first interior wall panel and the first exterior wall panel, a second intermediate wall panel disposed between the second interior wall panel and the second exterior wall panel, a third intermediate wall panel disposed between the third interior wall panel and the third exterior wall panel, and a fourth intermediate wall panel disposed between the fourth interior wall panel and the fourth exterior wall panel.

As will be appreciated by one of ordinary skill in the art, the present invention may be embodied as an apparatus (including, for example, a system, a machine, a device, and/or the like), as a method (including, for example, a business process, and/or the like), or as any combination of the foregoing.

Embodiments of the invention can be manifest in the form of methods and apparatuses for practicing those methods.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A modular assembly shelter kit, comprising:

a header;

a first upper horizontal beam having an interior groove, an exterior groove, an interior ledge, and a hook with an upward facing notch;

a second upper horizontal beam having an interior groove, an exterior groove, an interior ledge, and a hook with a downward facing notch;

a roof panel;

a vertical support column;

an interior wall panel;

an exterior wall panel;

a first lower horizontal beam having an interior groove, an exterior groove, an interior ledge, and a hook with an upward facing notch;

a second lower horizontal beam having an interior groove, an exterior groove, an interior ledge, and a hook with a downward facing notch;

a floor panel; and a footer, wherein the vertical support column comprises a plurality of upper prongs and a plurality of lower prongs, wherein the notch of the first upper horizontal beam and the notch of the second upper horizontal beam interlock so that the hook of the first upper horizontal beam and the hook of the second upper horizontal beam form an upper cross joint, the upper cross joint is disposed below the header, and the vertical support column cages the upper cross joint when the plurality of upper prongs of the vertical support column engage the header, wherein the notch of the first lower horizontal beam and the notch of the second lower horizontal beam interlock so that the hook of the first lower horizontal beam and the hook of the second lower horizontal beam form a lower cross joint, the lower cross joint is disposed above the footer, and the vertical support column cages the lower cross joint when the plurality of lower prongs of the vertical support column engage the footer, wherein the roof panel is disposed above the interior ledge of the first upper horizontal beam and the interior ledge of the second upper horizontal beam, and the floor panel is disposed above the interior ledge of the first lower horizontal beam and the interior ledge of the second lower horizontal beam, wherein the interior wall panel is engaged with the interior groove of the first upper horizontal beam or the interior groove of the second upper horizontal beam, and with the interior groove of the first lower horizontal beam or the interior groove of the second lower horizontal beam, and wherein the exterior wall panel is engaged with the exterior groove of the first upper horizontal beam or the exterior groove of the second upper horizontal beam, and with the exterior groove of the first lower horizontal beam or the exterior groove of the second lower horizontal beam.

2. The modular assembly shelter kit of claim 1, wherein the interior wall panel is engaged with the interior groove of the first upper horizontal beam and the interior groove of the first lower horizontal beam.

3. The modular assembly shelter kit of claim 1, wherein the interior wall panel is engaged with the interior groove of the first upper horizontal beam and the interior groove of the second lower horizontal beam.

4. The modular assembly shelter kit of claim 1, wherein the interior wall panel is engaged with the interior groove of the second upper horizontal beam and the interior groove of the first lower horizontal beam.

5. The modular assembly shelter kit of claim 1, wherein the interior wall panel is engaged with the interior groove of the second upper horizontal beam and the interior groove of the second lower horizontal beam.

6. The modular assembly shelter kit of claim 1, wherein the exterior wall panel is engaged with the exterior groove of the first upper horizontal beam and the exterior groove of the first lower horizontal beam.

7. The modular assembly shelter kit of claim 1, wherein the exterior wall panel is engaged with the exterior groove of the first upper horizontal beam and the exterior groove of the second lower horizontal beam.

8. The modular assembly shelter kit of claim 1, wherein the exterior wall panel is engaged with the exterior groove of the second upper horizontal beam and the exterior groove of the first lower horizontal beam.

9. The modular assembly shelter kit of claim 1, wherein the exterior wall panel is engaged with the exterior groove of the second upper horizontal beam and the exterior groove of the second lower horizontal beam.

10. A modular assembly shelter kit, comprising:

a header having a central opening with four channels;

a first upper horizontal beam having an interior groove, an exterior groove, an interior ledge, and a hook with an upward facing notch;

a second upper horizontal beam having an interior groove, an exterior groove, an interior ledge, and a hook with a downward facing notch;

a roof panel;

a vertical support column having four upper prongs and four lower prongs;

an interior wall panel;

an exterior wall panel;

a first lower horizontal beam having an interior groove, an exterior groove, an interior ledge, and a hook with an upward facing notch;

a second lower horizontal beam having an interior groove, an exterior groove, an interior ledge, and a hook with a downward facing notch;

a floor panel; and a footer having a central opening with four channels, wherein the notch of the first upper horizontal beam and the notch of the second upper horizontal beam interlock so that the hook of the first upper horizontal beam and the hook of the second upper horizontal beam form an upper cross joint, the upper cross joint is disposed below the header, and the vertical support column cages the upper cross joint when each of the four upper prongs of the vertical support column are inserted within respective channels of the header, wherein the notch of the first lower horizontal beam and the notch of the second lower horizontal beam interlock so that the hook of the first lower horizontal beam and the hook of the second lower horizontal beam form a lower cross joint, the lower cross joint is disposed above the footer, and the vertical support column cages the lower cross joint when each of the four lower prongs of the vertical support column are inserted within respective channels of the footer, wherein the roof panel is disposed above the interior ledge of the first upper horizontal beam and the interior ledge of the second upper horizontal beam, wherein the floor panel is disposed above the interior ledge of the first lower horizontal beam and the interior ledge of the second lower horizontal beam, wherein the interior wall panel is engaged with the interior groove of the first upper horizontal beam or the interior groove of the second upper horizontal beam, wherein the interior wall panel is engaged with the interior groove of the first lower horizontal beam or the interior groove of the second lower horizontal beam, wherein the exterior wall panel is engaged with the exterior groove of the first upper horizontal beam or the exterior groove of the second upper horizontal beam, and wherein the exterior wall panel is engaged with the exterior groove of the first lower horizontal beam or the exterior groove of the second lower horizontal beam.

11. The modular assembly shelter kit of claim 10, wherein the interior wall panel is engaged with the interior groove of the first upper horizontal beam and the interior groove of the first lower horizontal beam.

12. The modular assembly shelter kit of claim 10, wherein the interior wall panel is engaged with the interior groove of the first upper horizontal beam and the interior groove of the second lower horizontal beam.

13. The modular assembly shelter kit of claim 10, wherein the interior wall panel is engaged with the interior groove of the second upper horizontal beam and the interior groove of the first lower horizontal beam.

14. The modular assembly shelter kit of claim 10, wherein the interior wall panel is engaged with the interior groove of the second upper horizontal beam and the interior groove of the second lower horizontal beam.

15. The modular assembly shelter kit of claim 10, wherein the exterior wall panel is engaged with the exterior groove of the first upper horizontal beam and the exterior groove of the first lower horizontal beam.

16. The modular assembly shelter kit of claim 10, wherein the exterior wall panel is engaged with the exterior groove of the first upper horizontal beam and the exterior groove of the second lower horizontal beam.

17. The modular assembly shelter kit of claim 10, wherein the exterior wall panel is engaged with the exterior groove of the second upper horizontal beam and the exterior groove of the first lower horizontal beam.

18. The modular assembly shelter kit of claim 10, wherein the exterior wall panel is engaged with the exterior groove of the second upper horizontal beam and the exterior groove of the second lower horizontal beam.

19. A modular assembly shelter kit, comprising:

a first header, a second header, a third header, and a fourth header;

an upper panel;

a first upper horizontal beam, a second upper horizontal beam, a third upper horizontal beam, and a fourth upper horizontal beam;

a first interior wall panel, a second interior wall panel, a third interior wall panel, and a fourth interior wall panel;

a first exterior wall panel, a second exterior wall panel, a third exterior wall panel, and a fourth exterior wall panel;

a first vertical support column, a second vertical support column, a third vertical support column, and a fourth vertical support column;

a first vertical coupler, a second vertical coupler, a third vertical coupler, a fourth vertical coupler, a fifth vertical coupler, a sixth vertical coupler, a seventh vertical coupler, and an eighth vertical coupler;

a first lower horizontal beam, a second lower horizontal beam, a third lower horizontal beam, and a fourth lower horizontal beam;

a lower panel; and a first footer, a second footer, a third footer, and a fourth footer, wherein the first header has a first channel, a second channel, a third channel, and a fourth channel, the second header has a first channel, a second channel, a third channel, and a fourth channel, the third header has a first channel, a second channel, a third channel, and a fourth channel, and the fourth header has a first channel, a second channel, a third channel, and a fourth channel, wherein the first upper horizontal beam has a first hook with a first upward facing notch, a second hook with a second upward facing notch, an interior groove, an exterior groove, and an interior ledge, the second upper horizontal beam has a first hook with a first downward facing notch, a second hook with a second downward facing notch, an interior groove, an exterior groove, and an interior ledge, the third upper horizontal beam has a first hook with a first upward facing notch, a second hook with a second upward facing notch, an interior groove, an exterior groove, and an interior ledge, and the fourth upper horizontal beam has a first hook with a first downward facing notch, a second hook with a second downward facing notch, an interior groove, an exterior groove, and an interior ledge, wherein the first vertical support column has a first upper prong, a second upper prong, a third upper prong, a fourth upper prong, a first lower prong, a second lower prong, a third lower prong, a fourth lower prong, a first engagement mechanism, and a second engagement mechanism, wherein the second vertical support column has a first upper prong, a second upper prong, a third upper prong, a fourth upper prong, a first lower prong, a second lower prong, a third lower prong, a fourth lower prong, a first engagement mechanism, and a second engagement mechanism, wherein the third vertical support column has a first upper prong, a second upper prong, a third upper prong, a fourth upper prong, a first lower prong, a second lower prong, a third lower prong, a fourth lower prong, a first engagement mechanism, and a second engagement mechanism, wherein the fourth vertical support column has a first upper prong, a second upper prong, a third upper prong, a fourth upper prong, a first lower prong, a second lower prong, a third lower prong, a fourth lower prong, a first engagement mechanism, and a second engagement mechanism, wherein the first vertical coupler has an interior groove, an exterior groove, and an engagement mechanism, the second vertical coupler has an interior groove, an exterior groove, and an engagement mechanism, the third vertical coupler has an interior groove, an exterior groove, and an engagement mechanism, the fourth vertical coupler has an interior groove, an exterior groove, and an engagement mechanism, the fifth vertical coupler has an interior groove, an exterior groove, and an engagement mechanism, the sixth vertical coupler has an interior groove, an exterior groove, and an engagement mechanism, the seventh vertical coupler has an interior groove, an exterior groove, and an engagement mechanism, and the eighth vertical coupler has an interior groove, an exterior groove, and an engagement mechanism, wherein the first lower horizontal beam has a first hook with a first upward facing notch, a second hook with an upward facing notch, an interior groove, an exterior groove, and an interior ledge, the second lower horizontal beam has a first hook with a first downward facing notch, a second hook with a second downward facing notch, an interior groove, an exterior groove, and an interior ledge, the third lower horizontal beam has a first hook with a first upward facing notch, a second hook with a second upward facing notch, an interior groove, an exterior groove, and an interior ledge, and the fourth lower horizontal beam has a first hook with a first downward facing notch, a second hook with a second downward facing notch, an interior groove, an exterior groove, and an interior ledge, wherein the first footer has a first channel, a second channel, a third channel, and a fourth channel, the second footer has a first channel, a second channel, a third channel, and a fourth channel, the third footer has a first channel, a second channel, a third channel, and a fourth channel, and the fourth footer has a first channel, a second channel, a third channel, and a fourth channel, wherein the first notch of the first upper horizontal beam and the second notch of the fourth upper horizontal beam interlock so that the first hook of the first upper horizontal beam and the second hook of the fourth upper horizontal beam form a first upper cross joint, the second notch of the first upper horizontal beam and the first notch of the second upper horizontal beam interlock so that the second hook of the first upper horizontal beam and the first hook of the second upper horizontal beam form a second upper cross joint, the second notch of the second upper horizontal beam and the first notch of the third upper horizontal beam interlock so that the second hook of the second upper horizontal beam and the first hook of the third upper horizontal beam form a third upper cross joint, the second notch of the third upper horizontal beam and the first notch of the fourth upper horizontal beam interlock so that the second hook of the third upper horizontal beam and the first hook of the fourth upper horizontal beam form a fourth upper cross joint, wherein the first notch of the first lower horizontal beam and the second notch of the fourth lower horizontal beam interlock so that the first hook of the first lower horizontal beam and the second hook of the fourth lower horizontal beam form a first lower cross joint, the second notch of the first lower horizontal beam and the first notch of the second lower horizontal beam interlock so that the second hook of the first lower horizontal beam and the first hook of the second lower horizontal beam form a second lower cross joint, the second notch of the second lower horizontal beam and the first notch of the third lower horizontal beam interlock so that the second hook of the second lower horizontal beam and the first hook of the third lower horizontal beam form a third lower cross joint, the second notch of the third lower horizontal beam and the first notch of the fourth lower horizontal beam interlock so that the second hook of the third lower horizontal beam and the first hook of the fourth lower horizontal beam form a fourth lower cross joint, wherein the first lower cross joint is disposed above the first footer, and the first vertical support column cages the first lower cross joint when the first lower prong of the first vertical support column is inserted in the first channel of the first footer, the second lower prong of the first vertical support column is inserted in the second channel of the first footer, the third lower prong of the first vertical support column is inserted in the third channel of the first footer, and the fourth lower prong of the first vertical support column is inserted in the fourth channel of the first footer, wherein the second lower cross joint is disposed above the second footer, and the second vertical support column cages the second lower cross joint when the first lower prong of the second vertical support column is inserted in the first channel of the second footer, the second lower prong of the second vertical support column is inserted in the second channel of the second footer, the third lower prong of the second vertical support column is inserted in the third channel of the second footer, and the fourth lower prong of the second vertical support column is inserted in the fourth channel of the second footer, wherein the third lower cross joint is disposed above the third footer, and the third vertical support column cages the third lower cross joint when the first lower prong of the third vertical support column is inserted in the first channel of the third footer, the second lower prong of the third vertical support column is inserted in the second channel of the third footer, the third lower prong of the third vertical support column is inserted in the third channel of the third footer, and the fourth lower prong of the third vertical support column is inserted in the fourth channel of the third footer, wherein the fourth lower cross joint is disposed above the fourth footer, and the fourth vertical support column cages the fourth lower cross joint when the first lower prong of the fourth vertical support column is inserted in the first channel of the fourth footer, the second lower prong of the fourth vertical support column is inserted in the second channel of the fourth footer, the third lower prong of the fourth vertical support column is inserted in the third channel of the fourth footer, and the fourth lower prong of the fourth vertical support column is inserted in the fourth channel of the fourth footer, wherein the engagement mechanism of the first coupler attaches with the first engagement mechanism of the first vertical support column, the engagement mechanism of the second coupler attaches with the second engagement mechanism of the second vertical support column, the engagement mechanism of the third coupler attaches with the first engagement mechanism of the second vertical support column, the engagement mechanism of the fourth coupler attaches with the second engagement mechanism of the third vertical support column, the engagement mechanism of the fifth coupler attaches with the first engagement mechanism of the third vertical support column, the engagement mechanism of the sixth coupler attaches with the second engagement mechanism of the fourth vertical support column, the engagement mechanism of the seventh coupler attaches with the first engagement mechanism of the fourth vertical support column, and the engagement mechanism of the eighth coupler attaches with the second engagement mechanism of the first vertical support column, wherein the first upper cross joint is disposed below the first header, and the first vertical support column cages the first upper cross joint when the first upper prong of the first vertical support column is inserted in the first channel of the first header, the second upper prong of the first vertical support column is inserted in the second channel of the first header, the third upper prong of the first vertical support column is inserted in the third channel of the first header, and the fourth upper prong of the first vertical support column is inserted in the fourth channel of the first header, wherein the second upper cross joint is disposed below the second header, and the second vertical support column cages the second upper cross joint when the first upper prong of the second vertical support column is inserted in the first channel of the second header, the second upper prong of the second vertical support column is inserted in the second channel of the second header, the third upper prong of the second vertical support column is inserted in the third channel of the second header, and the fourth upper prong of the second vertical support column is inserted in the fourth channel of the second header, wherein the third upper cross joint is disposed below the third header, and the third vertical support column cages the third upper cross joint when the first upper prong of the third vertical support column is inserted in the first channel of the third header, the second upper prong of the third vertical support column is inserted in the second channel of the third header, the third upper prong of the third vertical support column is inserted in the third channel of the third header, and the fourth upper prong of the third vertical support column is inserted in the fourth channel of the third header, wherein the fourth upper cross joint is disposed below the fourth header, and the fourth vertical support column cages the fourth upper cross joint when the first upper prong of the fourth vertical support column is inserted in the first channel of the fourth header, the second upper prong of the fourth vertical support column is inserted in the second channel of the fourth header, the third upper prong of the fourth vertical support column is inserted in the third channel of the fourth header, and the fourth upper prong of the fourth vertical support column is inserted in the fourth channel of the fourth header, wherein the first interior wall panel is secured by the interior groove of the first coupler, the interior groove of the second coupler, the interior groove of the first upper horizontal beam, and the interior groove of the first lower horizontal beam, wherein the second interior wall panel is secured by the interior groove of the third coupler, the interior groove of the fourth coupler, the interior groove of the second upper horizontal beam, and the interior groove of the second lower horizontal beam, wherein the third interior wall panel is secured by the interior groove of the fifth coupler, the interior groove of the sixth coupler, the interior groove of the third upper horizontal beam, and the interior groove of the third lower horizontal beam, wherein the fourth interior wall panel is secured by the interior groove of the seventh coupler, the interior groove of the eighth coupler, the interior groove of the fourth upper horizontal beam, and the interior groove of the fourth lower horizontal beam, wherein the first exterior wall panel is secured by the exterior groove of the first coupler, the exterior groove of the second coupler, the exterior groove of the first upper horizontal beam, and the exterior groove of the first lower horizontal beam, wherein the second exterior wall panel is secured by the exterior groove of the third coupler, the exterior groove of the fourth coupler, the exterior groove of the second upper horizontal beam, and the exterior groove of the second lower horizontal beam, wherein the third exterior wall panel is secured by the exterior groove of the fifth coupler, the exterior groove of the sixth coupler, the exterior groove of the third upper horizontal beam, and the exterior groove of the third lower horizontal beam, wherein the fourth exterior wall panel is secured by the exterior groove of the seventh coupler, the exterior groove of the eighth coupler, the exterior groove of the fourth upper horizontal beam, and the exterior groove of the fourth lower horizontal beam, wherein the upper panel is disposed upon the interior ledge of the first upper horizontal beam, the interior ledge of the second upper horizontal beam, the interior ledge of the third upper horizontal beam, and the interior ledge of the fourth upper horizontal beam, and wherein the lower panel is disposed upon the interior ledge of the first lower horizontal beam, the interior ledge of the second lower horizontal beam, the interior ledge of the third lower horizontal beam, and the interior ledge of the fourth lower horizontal beam.

20. The modular assembly shelter kit of claim 19, further comprising a first intermediate wall panel disposed between the first interior wall panel and the first exterior wall panel, a second intermediate wall panel disposed between the second interior wall panel and the second exterior wall panel, a third intermediate wall panel disposed between the third interior wall panel and the third exterior wall panel, and a fourth intermediate wall panel disposed between the fourth interior wall panel and the fourth exterior wall panel.

* * * * *